US012075819B2

(12) United States Patent
Cox et al.

(10) Patent No.: US 12,075,819 B2
(45) Date of Patent: Sep. 3, 2024

(54) AEROSOL DELIVERY DEVICE WITH CONSUMABLE CARTRIDGE

(71) Applicant: R.J. Reynolds Tobacco Company, Winston-Salem, NC (US)

(72) Inventors: Keri Meggan Cox, Pleasant Garden, NC (US); Jason Lee Wood, Lexington, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1100 days.

(21) Appl. No.: 16/515,637

(22) Filed: Jul. 18, 2019

(65) Prior Publication Data

US 2021/0015173 A1 Jan. 21, 2021

(51) Int. Cl.

| | |
|---|---|
| ***A24F 42/60*** | (2020.01) |
| ***A24B 15/16*** | (2020.01) |
| ***A24D 1/14*** | (2006.01) |
| ***A24F 42/10*** | (2020.01) |

(52) U.S. Cl.
CPC ..... *A24D 1/14* (2013.01); *A24B 15/165* (2013.01); *A24F 42/10* (2020.01); *A24F 42/60* (2020.01)

(58) Field of Classification Search
CPC ..... A24F 42/60
USPC ..... 131/329
See application file for complete search history.

(56) References Cited

U.S. PATENT DOCUMENTS

| | | | |
|---|---|---|---|
| 1,464,300 | A | 8/1923 | Taff |
| 1,505,655 | A | 8/1924 | Marek |
| 1,541,891 | A | 6/1925 | Becker |
| 1,607,132 | A | 11/1926 | Kuno |

(Continued)

FOREIGN PATENT DOCUMENTS

| | | | |
|---|---|---|---|
| EP | 0174645 | A2 | 5/1987 |
| JP | 2002034543 | A | 2/2002 |

(Continued)

OTHER PUBLICATIONS

International Search Report from the corresponding International Application No. PCT/IB2020/056714, mailed Nov. 11, 2020.

(Continued)

*Primary Examiner* — Russell E Sparks
(74) *Attorney, Agent, or Firm* — WOMBLE BOND DICKINSON (US) LLP

(57) ABSTRACT

The present disclosure is directed to an aerosol delivery device and a cartridge for use with an aerosol delivery device. In some implementations, the aerosol delivery device may comprise a holder, and a cartridge comprising an outer housing, a heat portion comprising a heat source, and a substrate portion comprising a substrate material including an aerosol precursor composition. The outer housing may comprise a heat end and a substrate end, wherein at least one of the ends of the outer housing includes at least one opening, and wherein the cartridge is configured to be removable and replaceable within the holder. Some implementations may include an intermediate housing, wherein the heat portion and the substrate portion are contained within the intermediate housing. Other implementations may include an inner housing, wherein an inner chamber is defined within the inner housing and an outer chamber is defined between the inner and outer housings.

5 Claims, 24 Drawing Sheets

(56) References Cited

U.S. PATENT DOCUMENTS

| | | | |
|---|---|---|---|
| 1,613,545 | A | 1/1927 | Teigen |
| 1,941,531 | A | 1/1934 | Blankenship |
| 2,008,433 | A | 7/1935 | Ashour |
| 2,373,629 | A | 4/1945 | Kilgore |
| 2,455,492 | A | 12/1948 | Jackson |
| 2,502,831 | A | 4/1950 | Daze |
| 2,541,837 | A | 2/1951 | Schroff |
| 2,701,571 | A | 2/1955 | Dittrich |
| 2,711,176 | A | 6/1955 | Vakilian |
| 2,779,340 | A | 1/1957 | Mansfield |
| 2,953,136 | A | 9/1960 | Dahly |
| 3,155,099 | A | 11/1964 | Minchin |
| 3,181,538 | A | 5/1965 | Piliego |
| 3,685,520 | A | 8/1972 | Chernack |
| 4,708,151 | A | 11/1987 | Shelar |
| 4,714,082 | A | 12/1987 | Banerjee et al. |
| 4,881,556 | A | 11/1989 | Clearman et al. |
| 4,966,171 | A | 10/1990 | Serrano et al. |
| 4,991,606 | A | 2/1991 | Serrano et al. |
| 5,040,552 | A | 8/1991 | Schleich et al. |
| 5,060,676 | A | 10/1991 | Hearn et al. |
| 5,076,296 | A | 12/1991 | Nystrom et al. |
| 5,156,170 | A | 10/1992 | Clearman et al. |
| 5,159,940 | A | 11/1992 | Hayward et al. |
| 5,178,165 | A | 1/1993 | DeFelice |
| 5,240,012 | A | 8/1993 | Ehrman et al. |
| 5,592,955 | A | 1/1997 | Keritsis |
| 5,595,577 | A | 1/1997 | Bensalem et al. |
| 5,692,525 | A | 12/1997 | Counts et al. |
| 5,845,649 | A | 12/1998 | Saito et al. |
| 6,006,757 | A | 12/1999 | Lichtenberg |
| 6,053,176 | A | 4/2000 | Adams et al. |
| 6,164,287 | A | 12/2000 | White |
| 6,311,694 | B1 | 11/2001 | Nichols et al. |
| 6,345,625 | B1 | 2/2002 | Chew |
| 6,371,127 | B1 | 4/2002 | Snaidr et al. |
| 6,431,177 | B1 | 8/2002 | Sieggen et al. |
| 6,532,965 | B1 | 3/2003 | Abhulimen et al. |
| 6,615,843 | B2 | 9/2003 | Pera |
| 6,748,955 | B2 | 6/2004 | Snaidr et al. |
| 7,080,649 | B2 | 7/2006 | Hcu |
| 7,503,330 | B2 | 3/2009 | Borschke et al. |
| 7,600,517 | B1 | 10/2009 | Holzrichter |
| 7,624,739 | B2 | 12/2009 | Snaidr et al. |
| 8,061,361 | B2 | 11/2011 | Maeder et al. |
| 8,151,803 | B2 | 4/2012 | Inagaki |
| 8,302,611 | B2 | 11/2012 | Rowley |
| 8,528,567 | B2 | 9/2013 | Hajaligol |
| 8,616,217 | B2 | 12/2013 | Tsurizumi et al. |
| 8,776,803 | B2 | 7/2014 | Tarora et al. |
| 8,863,754 | B2 | 10/2014 | Renaud et al. |
| 8,915,255 | B2 | 12/2014 | Poget et al. |
| 9,078,473 | B2 | 7/2015 | Worm et al. |
| 9,149,072 | B2 | 10/2015 | Conner et al. |
| 9,220,301 | B2 | 12/2015 | Banerjee et al. |
| 9,282,769 | B2 | 3/2016 | Mishra et al. |
| 9,301,546 | B2 | 4/2016 | Thomas et al. |
| 9,332,784 | B2 | 5/2016 | Banerjee et al. |
| 9,439,453 | B2 | 9/2016 | Conner et al. |
| 9,532,591 | B2 | 1/2017 | Mironov |
| 9,549,572 | B2 | 1/2017 | Dincer et al. |
| 9,609,893 | B2 | 4/2017 | Novak, III et al. |
| 9,629,393 | B2 | 4/2017 | Stolz et al. |
| 9,693,587 | B2 | 7/2017 | Plojoux |
| 9,717,273 | B2 | 8/2017 | Poget et al. |
| 9,730,468 | B2 | 8/2017 | Poget et al. |
| 9,801,412 | B2 | 10/2017 | Grant |
| 9,894,930 | B2 | 2/2018 | Bonici et al. |
| 9,918,494 | B2 | 3/2018 | Mironov et al. |
| 9,930,915 | B2 | 4/2018 | Worm et al. |
| 9,943,114 | B2 | 4/2018 | Batista |
| 9,961,939 | B2 | 5/2018 | Reevell |
| 10,034,493 | B2 | 7/2018 | Akiyama et al. |
| 10,064,428 | B2 | 9/2018 | Swepston et al. |
| 10,064,478 | B2 | 9/2018 | Brooks |
| 10,111,463 | B2 | 10/2018 | Batista |
| 10,159,277 | B2 | 12/2018 | Bonnely |
| 10,212,968 | B2 | 2/2019 | Mironov et al. |
| 10,398,168 | B2 | 9/2019 | Maiwald et al. |
| 10,470,491 | B2 | 11/2019 | Sutton et al. |
| 10,492,526 | B2 | 12/2019 | Sampson et al. |
| 10,524,503 | B2 | 1/2020 | Florack et al. |
| 10,827,780 | B2 | 11/2020 | Swepston et al. |
| 2008/0047570 | A1 | 2/2008 | Plank |
| 2009/0065011 | A1 | 3/2009 | Maeder et al. |
| 2011/0083674 | A1 | 4/2011 | Karpinsky |
| 2013/0133675 | A1 | 5/2013 | Shinozaki et al. |
| 2013/0167850 | A1 | 7/2013 | Al-Aawar |
| 2013/0228190 | A1 | 9/2013 | Weiss et al. |
| 2014/0048085 | A1 | 2/2014 | Cox |
| 2015/0034100 | A1 | 2/2015 | Park et al. |
| 2015/0040924 | A1 | 2/2015 | Mironov et al. |
| 2015/0296882 | A1 | 10/2015 | Mironov et al. |
| 2015/0342254 | A1 | 12/2015 | Mironov et al. |
| 2016/0007648 | A1 | 1/2016 | Sutton et al. |
| 2016/0007649 | A1 | 1/2016 | Sampson et al. |
| 2016/0120216 | A1 | 5/2016 | Mironov et al. |
| 2016/0135495 | A1 | 5/2016 | Poget et al. |
| 2016/0174609 | A1 | 6/2016 | Mironov |
| 2016/0192704 | A1 | 7/2016 | Bonnely |
| 2016/0316816 | A1 | 11/2016 | Lavanchy et al. |
| 2016/0360785 | A1 | 12/2016 | Bless et al. |
| 2017/0000189 | A1 | 1/2017 | Mironov et al. |
| 2017/0055577 | A1 | 3/2017 | Batista |
| 2017/0055578 | A1 | 3/2017 | Oda et al. |
| 2017/0164654 | A1 | 6/2017 | Ademe |
| 2017/0196261 | A1 | 7/2017 | Borges De Couraca et al. |
| 2017/0303585 | A1 | 10/2017 | Florack et al. |
| 2017/0318859 | A1 | 11/2017 | Batista |
| 2018/0000165 | A1 | 1/2018 | Liu |
| 2018/0014571 | A1 | 1/2018 | Nakano |
| 2018/0070640 | A1 | 3/2018 | Bessant et al. |
| 2018/0116280 | A1 | 5/2018 | Maiwald et al. |
| 2018/0192707 | A1 | 7/2018 | Worm et al. |
| 2018/0317560 | A1 | 11/2018 | Shinozaki et al. |
| 2018/0325167 | A1 | 11/2018 | Grant |
| 2018/0368468 | A1 | 12/2018 | Mishra et al. |
| 2019/0000135 | A1 | 1/2019 | Lavanant et al. |
| 2019/0000141 | A1 | 1/2019 | Rojo-Calderon et al. |
| 2019/0000142 | A1 | 1/2019 | Lavanchy et al. |
| 2019/0014818 | A1 | 1/2019 | Saygili |
| 2019/0014820 | A1 | 1/2019 | Malgat |
| 2019/0014821 | A1 | 1/2019 | Batista et al. |
| 2019/0059449 | A1 | 2/2019 | Akiyama et al. |
| 2019/0059450 | A1 | 2/2019 | Akiyama et al. |
| 2019/0075848 | A1 | 3/2019 | Worm et al. |
| 2019/0124972 | A1 | 5/2019 | Nakano |
| 2019/0124973 | A1 | 5/2019 | Nakano et al. |
| 2019/0133176 | A1 | 5/2019 | Nakano et al. |
| 2019/0150505 | A1 | 5/2019 | Ceppi et al. |
| 2019/0274358 | A1 | 9/2019 | Reevell |
| 2020/0015519 | A1 | 1/2020 | Conner et al. |
| 2020/0060333 | A1 | 2/2020 | Sutton et al. |
| 2020/0146349 | A1 | 5/2020 | Phillips et al. |
| 2020/0196660 | A1* | 6/2020 | Duc ..... A24C 5/10 |
| 2020/0268044 | A1 | 8/2020 | Wilson |
| 2020/0268056 | A1* | 8/2020 | Goldstein ..... A24F 42/60 |
| 2021/0015172 | A1 | 1/2021 | Conner et al. |
| 2021/0015174 | A1 | 1/2021 | Cox et al. |
| 2021/0015175 | A1 | 1/2021 | Jackson et al. |

FOREIGN PATENT DOCUMENTS

| | | | |
|---|---|---|---|
| RU | 2608277 | C2 | 1/2017 |
| WO | WO1995034226 | | 12/1995 |
| WO | WO1998054989 | | 12/1998 |
| WO | WO2009022232 | | 2/2009 |
| WO | WO2013072336 | | 5/2013 |
| WO | 2013083963 | A1 | 6/2013 |
| WO | WO2013149810 | | 10/2013 |
| WO | WO2013189836 | | 12/2013 |
| WO | WO2014037270 | | 3/2014 |
| WO | WO2014156838 | | 10/2014 |
| WO | 2014180893 | A1 | 11/2014 |

(56) References Cited

FOREIGN PATENT DOCUMENTS

| | | | |
|---|---|---|---|
| WO | WO2015097005 | | 7/2015 |
| WO | WO2015128384 | | 9/2015 |
| WO | WO2015151158 | | 10/2015 |
| WO | WO2015184744 | | 12/2015 |
| WO | WO2015197850 | | 12/2015 |
| WO | WO2017042297 | | 3/2017 |
| WO | WO2017108912 | | 6/2017 |
| WO | WO2017114760 | | 7/2017 |
| WO | WO2017115181 | | 7/2017 |
| WO | WO2017115182 | | 7/2017 |
| WO | WO2017115183 | | 7/2017 |
| WO | WO2017115184 | | 7/2017 |
| WO | WO2017115185 | | 7/2017 |
| WO | WO2017115188 | | 7/2017 |
| WO | WO2017115196 | | 7/2017 |
| WO | 2017/153591 | A1 | 9/2017 |
| WO | WO2017207442 | | 12/2017 |
| WO | WO2017212284 | | 12/2017 |
| WO | WO2018170800 | | 9/2018 |
| WO | WO2018201655 | | 11/2018 |
| WO | WO2019010680 | | 1/2019 |
| WO | 2020216762 | A1 | 10/2020 |

OTHER PUBLICATIONS

Stephenson, "A 'Safer' Cigarette? Prove It, Say Critics", JAMA, 2000, 283(19), pp. 2507-2508. doi:10.1001/jama.283.19.2507.

"Chemical and Biological Studies on New Cigarette Prototypes That Heat Instead of Burn Tobacco", R. J. Reynolds Tobacco Company, 1988.

* cited by examiner

AEROSOL DELIVERY DEVICE WITH CONSUMABLE CARTRIDGE

FIELD OF THE DISCLOSURE

The present disclosure relates to aerosol delivery devices and systems, such as smoking articles; and more particularly, to aerosol delivery devices and systems that utilize heat sources, such as combustible carbon-based ignition sources, for the production of aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles are made or derived from tobacco, or those articles can be characterized as otherwise incorporating tobacco for human consumption, and which are capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable components.

BRIEF SUMMARY

The present disclosure relates to aerosol delivery devices and cartridges for use with aerosol delivery devices. In one implementation, the present disclosure provides an aerosol delivery device that may comprise a holder and a cartridge comprising a rigid outer housing, a heat portion comprising a heat source configured to generate heat, and a substrate portion comprising a substrate material including an aerosol precursor composition. The outer housing may comprise a heat end and a substrate end, at least one of the ends of the outer housing may include at least one opening, and the cartridge may be configured to be removable and replaceable within the holder. In some implementations, the outer housing of the cartridge may have a substantially cylindrical shape. In some implementations, the heat source may comprise a carbon-based heat source. In some implementations, the substrate material may comprise one or more of tobacco-containing beads, tobacco shreds, tobacco strips, pieces of a reconstituted tobacco material, tobacco rods, or non-tobacco materials.

In some implementations, the heat portion and the substrate portion may be contained within the outer housing of the cartridge, and the cartridge may further comprise a barrier disposed between the heat portion and the substrate portion. In some implementations, the at least one opening of the outer housing of the cartridge may comprise a pair of elongate slots, and the elongate slots may be located on the substrate end of the outer housing. In some implementations, the barrier may comprise a porous barrier wall, and the porous barrier wall may include a plurality of substantially cylindrical openings disposed therethrough. In some implementations, the barrier may comprise a substantially non-porous barrier wall. Some implementations may further comprise at least one opening defined circumferentially around at least a portion of the outer housing proximate the barrier and the substrate portion, and the at least one opening may be configured to receive air flow in response to a draw by a user.

In another implementation, the present disclosure provides a cartridge for use with a holder of an aerosol delivery device. The cartridge may comprise an outer housing, an intermediate housing, a heat portion comprising a heat source configured to generate heat, and a substrate portion comprising a substrate material including an aerosol precursor composition. The outer housing may comprise a heat end and a substrate end, at least one of the ends of the outer housing may include at least one opening, the heat portion and the substrate portion may be contained within the intermediate housing, and the cartridge may be configured to be removable and replaceable within the holder. In some implementations, the intermediate housing may comprise a mesh enclosure. In some implementations, the outer housing may be configured to circumscribe at least a portion of the intermediate housing, and at least one end of the intermediate housing may include at least one opening. In some implementations, the at least one opening of the outer housing may comprise a pair of elongate slots, the elongate slots may be located on the substrate end of the outer housing, the at least one opening of the intermediate housing may comprise a plurality of substantially cylindrical openings, and the plurality of cylindrical openings may be located on the heat end of the intermediate housing.

Some implementations may further comprise a barrier disposed between the heat portion and the substrate portion. In some implementations, the barrier may comprise a porous barrier, and the porous barrier may include a wall having a plurality of substantially cylindrical openings disposed therethrough. Some implementations may further comprise at least one opening defined circumferentially around at least a portion of the outer housing proximate the barrier and the substrate portion. In some implementations, the barrier may comprise a non-porous barrier, and the non-porous barrier may comprise a wall. In some implementations, the at least one opening of the outer housing may comprise a pair of elongate slots. In some implementations, an opposite end of the housing may include at least one opening. Some implementations may further comprise at least one opening defined circumferentially around at least a portion of the outer housing proximate the substrate portion. In some implementations, the at least one opening of one end of the outer housing may comprise a pair of elongate slots, and the at least one opening of the opposite end of the outer housing may comprise a plurality of substantially cylindrical openings.

Some implementations may further comprise a second barrier disposed proximate a downstream end of the substrate material and a collection chamber defined between the second barrier and the substrate end of the outer housing. In some implementations, the first and second barriers may comprise porous barriers. In some implementations, the first porous barrier may comprise a barrier wall having a pair of elongate slots disposed therethrough, and the second porous barrier may comprise a barrier wall having a pair of elongate slots disposed therethrough. In some implementations, the barrier may comprise a porous barrier, and the porous barrier may include a barrier wall having a central opening and a plurality of peripheral openings. In some implementations, the at least one opening of the outer housing may comprise a pair of elongate slots, and the elongate slots may be located on the substrate end of the outer housing. In some implementations, the outer housing may include a plurality openings disposed circumferentially around at least a portion of the outer housing, and the plurality of peripheral openings of the barrier wall may be substantially aligned with the plurality of circumferential openings of the outer housing.

In another implementation, the present disclosure provides a cartridge for use with a holder of an aerosol delivery device. The cartridge may comprise an outer housing, a heat portion comprising a heat source configured to generate heat, and a substrate portion comprising a substrate material including an aerosol precursor composition, and an inner housing defined within the outer housing. At least one of the ends of the outer housing may include at least one opening, an inner chamber may be defined within the inner housing and an outer chamber may be defined between the inner and outer housings, and the cartridge may be configured to be removable and replaceable within the holder. In some implementations, the inner housing may have a substantially cylindrical shape and the outer housing may have a substantially cylindrical shape.

In some implementations, the inner chamber may comprise the heat portion and the outer chamber may comprise the substrate portion. In some implementations, the inner chamber may comprise the substrate portion and the outer chamber may comprise the heat portion. In some implementations, at least one opening of the outer housing may comprise a pair of elongate slots. In some implementations, the at least one opening of the outer housing may comprise plurality of radial openings. In some implementations, the at least one opening of the outer housing may comprise a pair of elongate slots and a plurality of radial openings. In some implementations, at least one opening may be defined on an opposite end of the outer housing. In some implementations, the at least one opening of the opposite end of the outer housing may comprise a plurality of radial openings.

These and other features, aspects, and advantages of the disclosure will be apparent from a reading of the following detailed description together with the accompanying drawings, which are briefly described below.

BRIEF DESCRIPTION OF THE DRAWINGS

Figure 1:
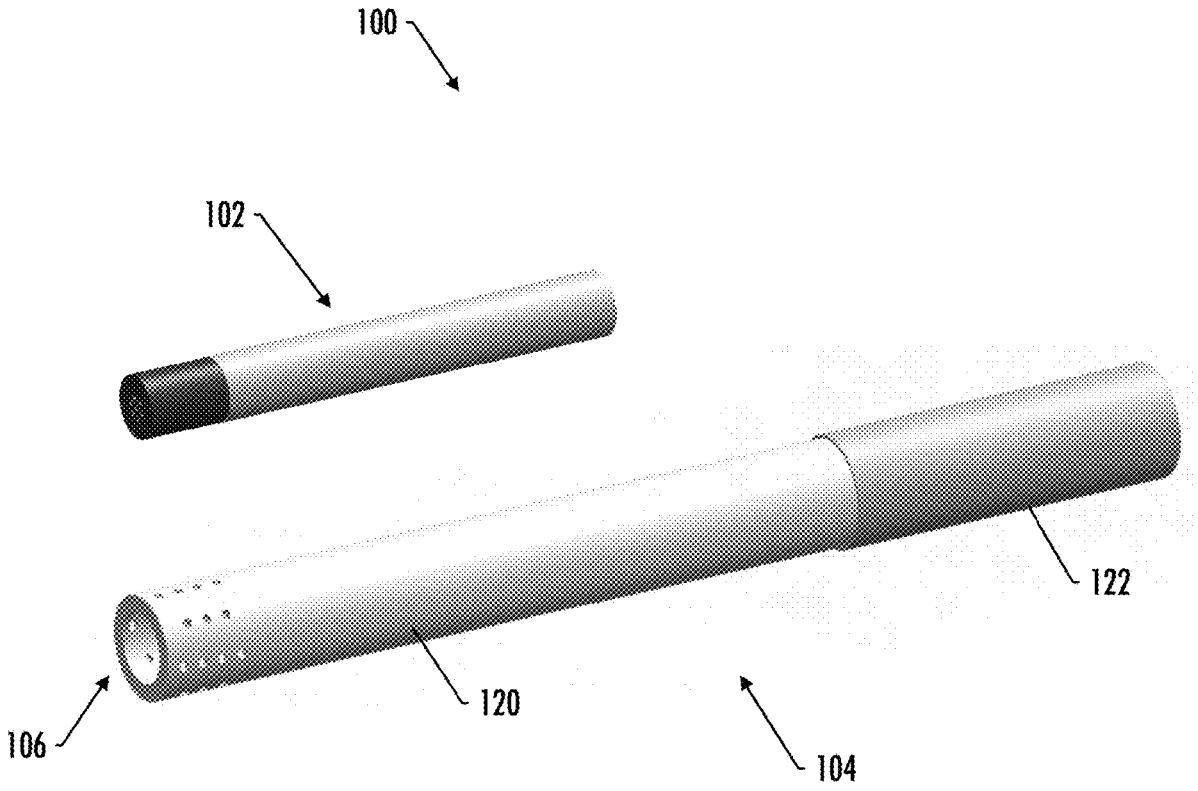
Figure 2:
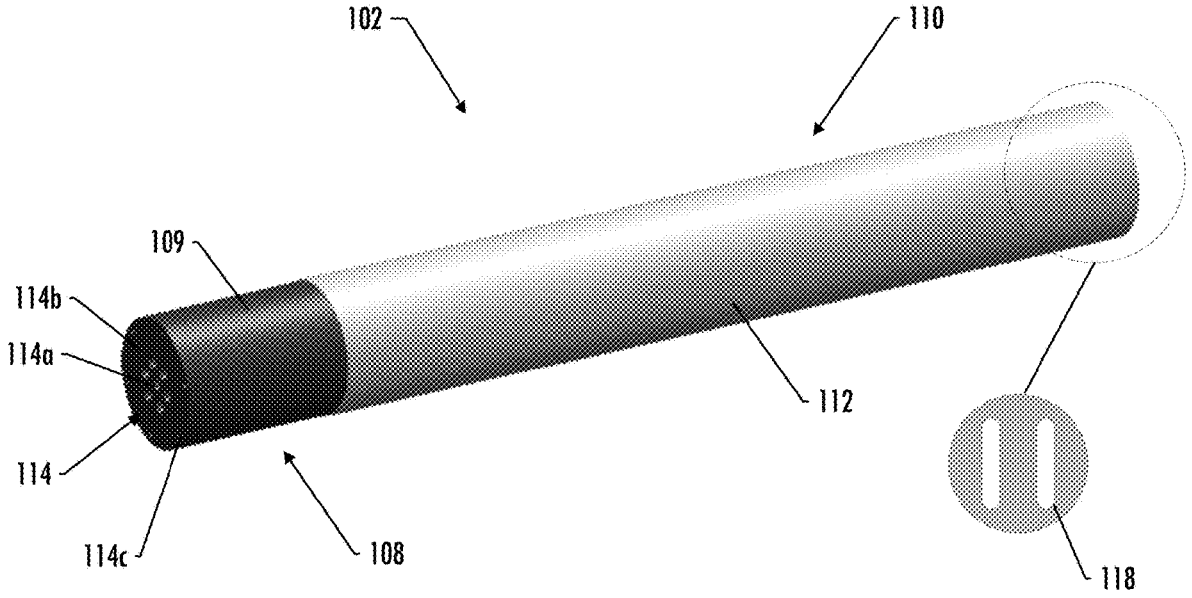
Figure 3:
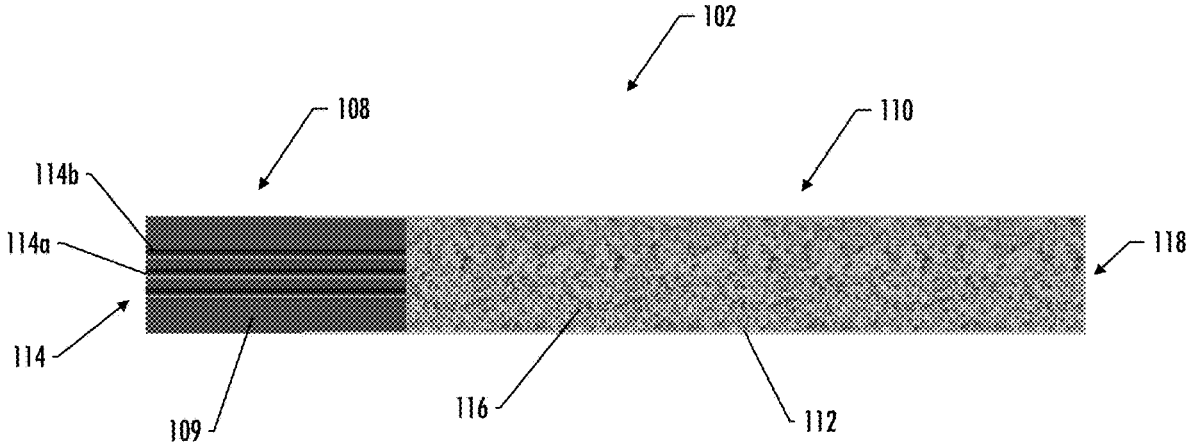
Figure 4A:
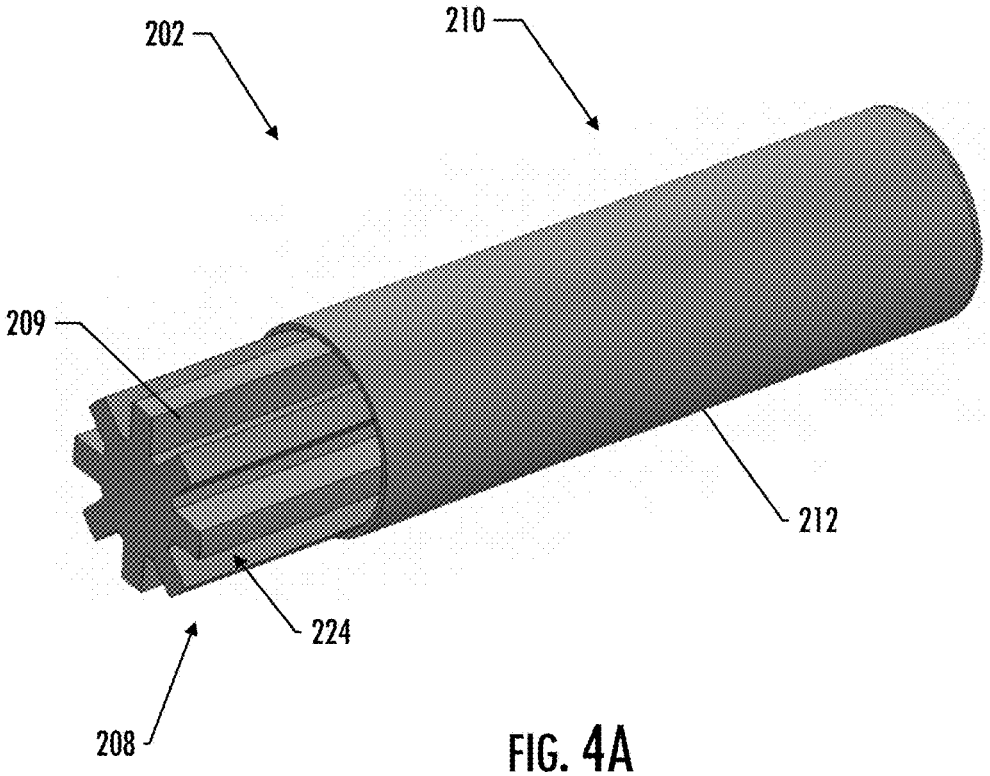
Figure 4B:
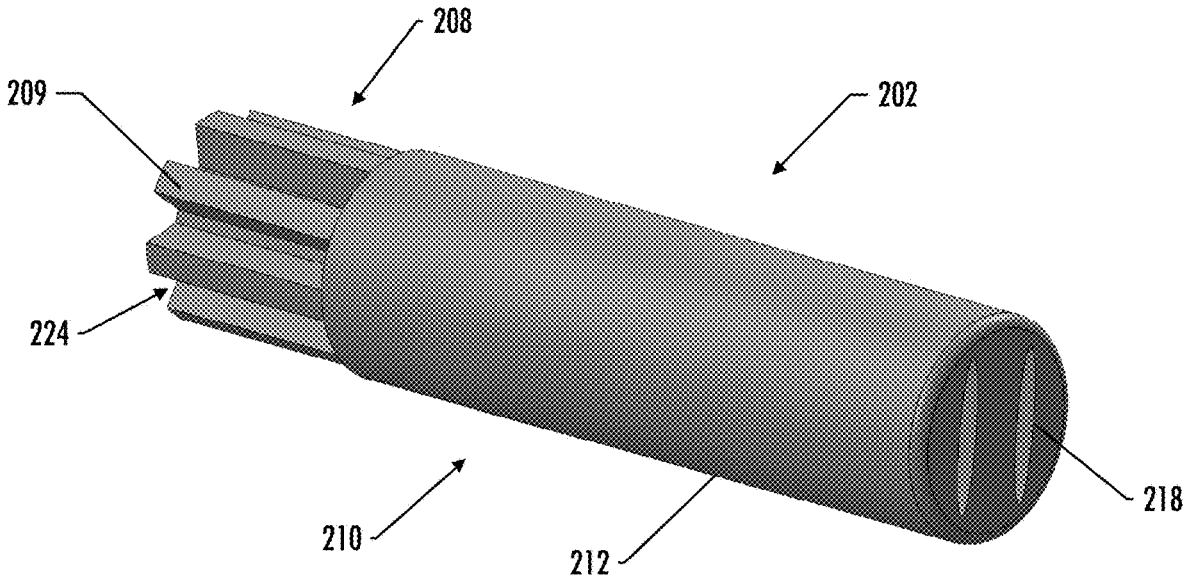
Figure 5:
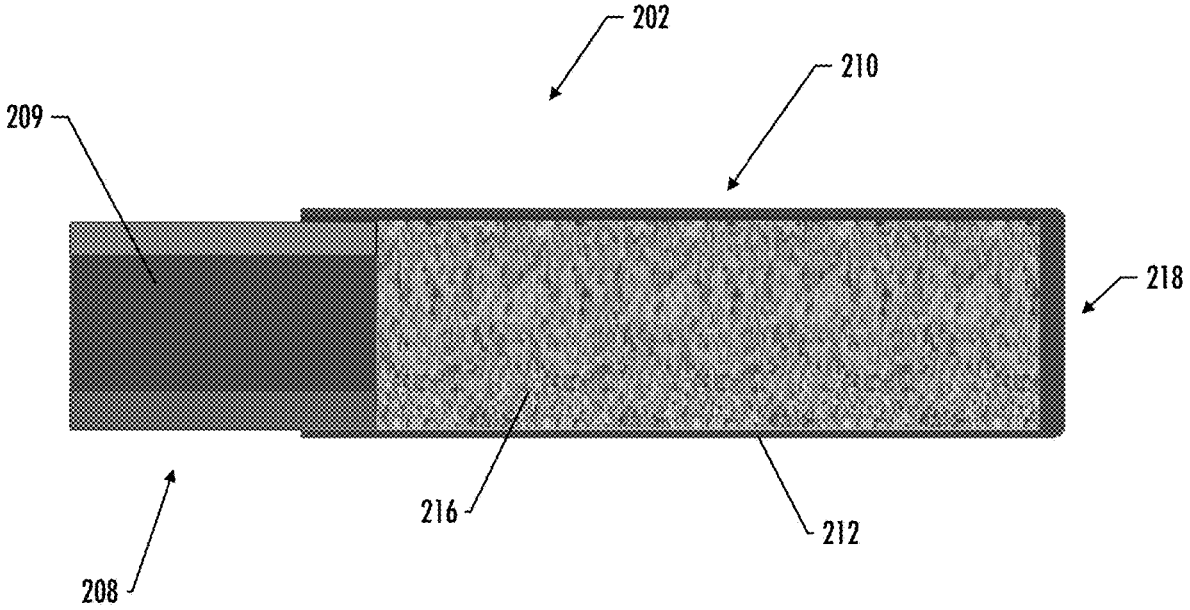
Figure 6A:
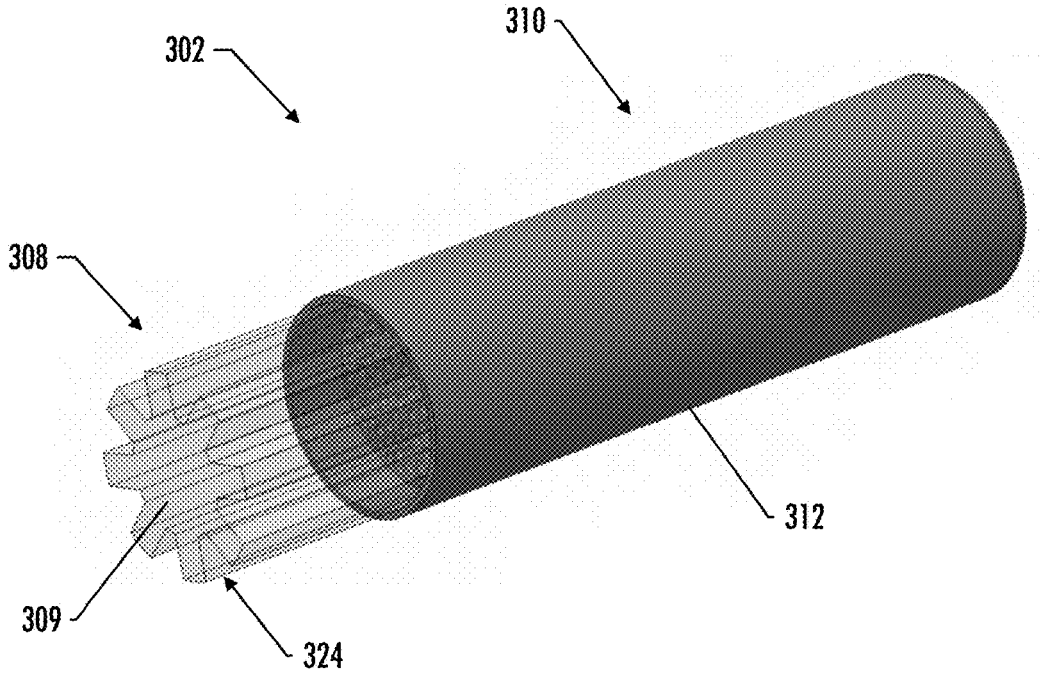
Figure 6B:
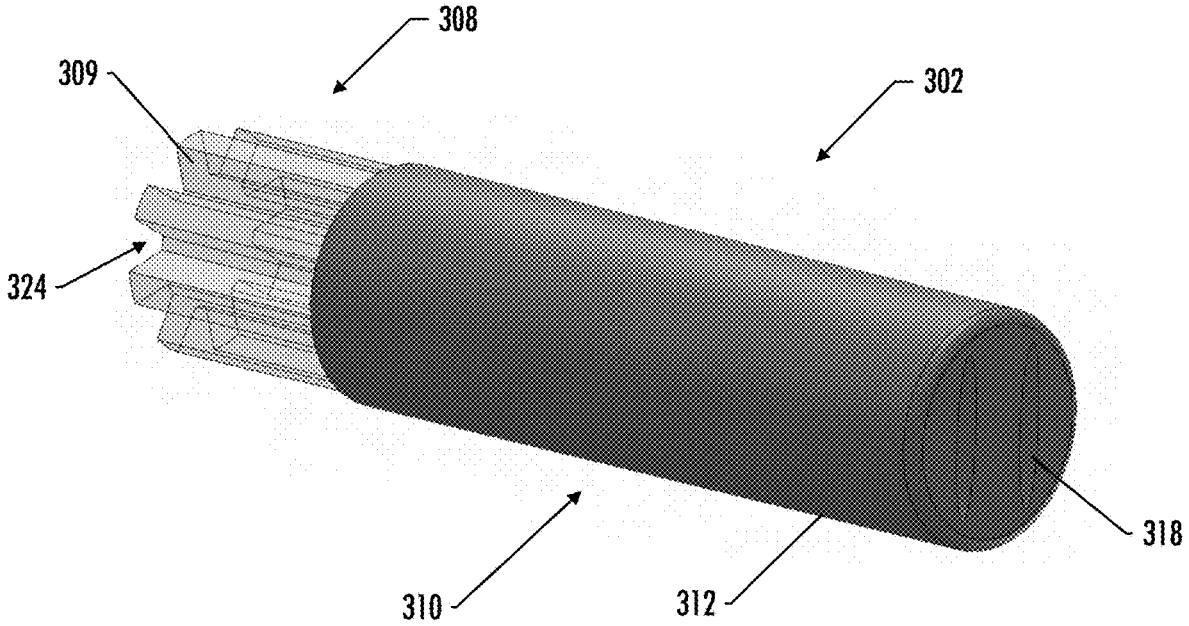
Figure 7:
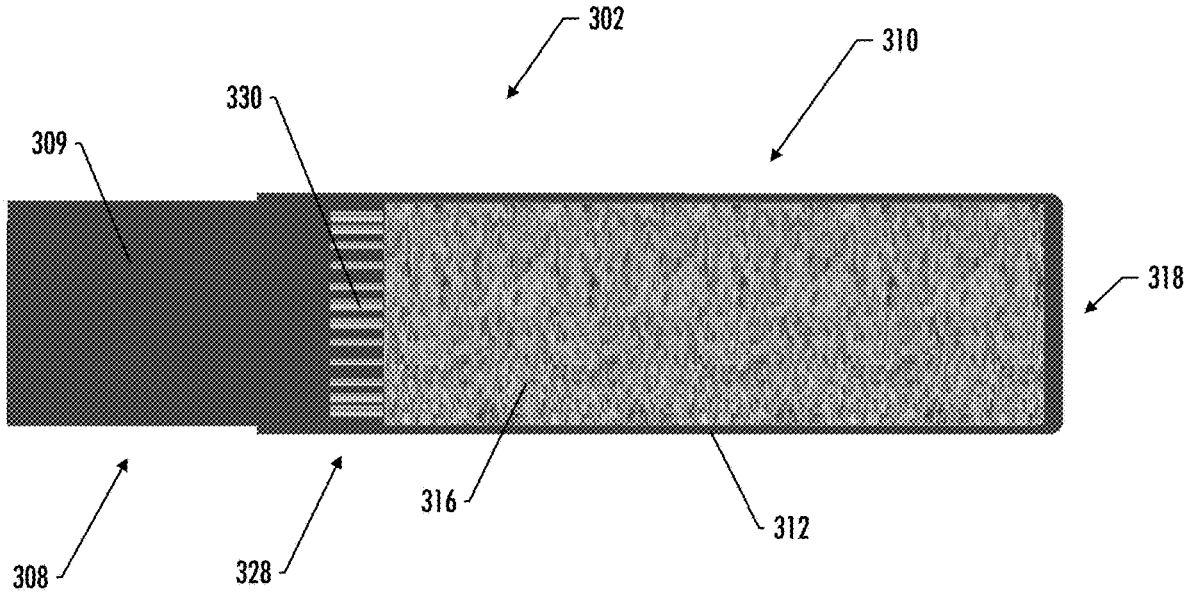
Figure 8A:
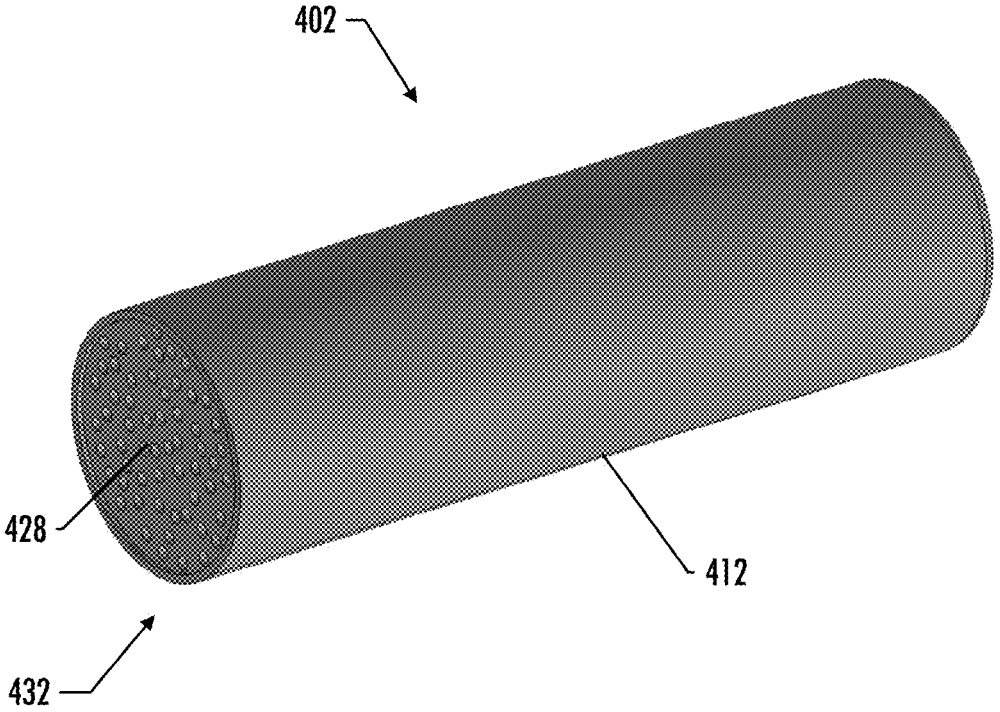
Figure 8B:
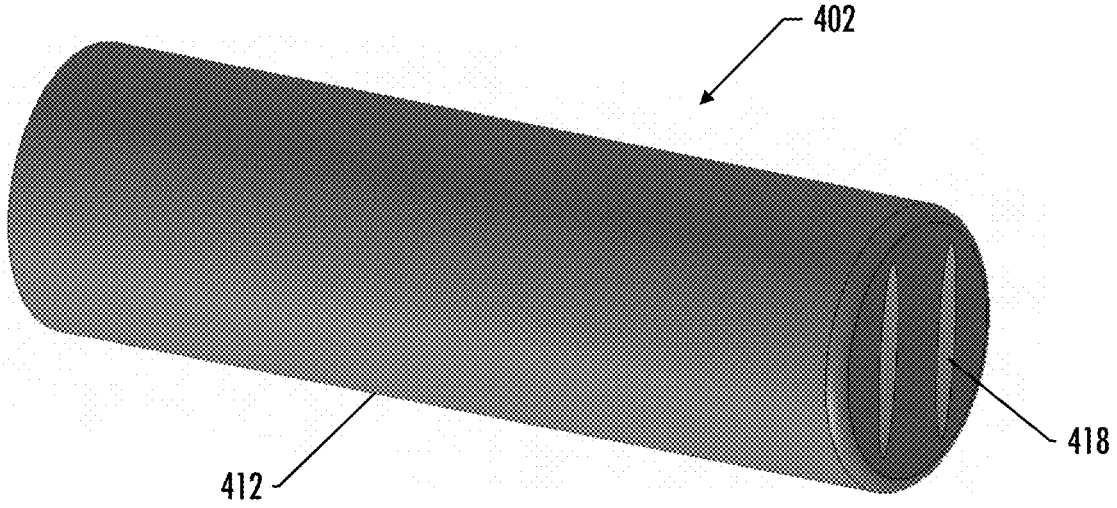
Figure 9A:
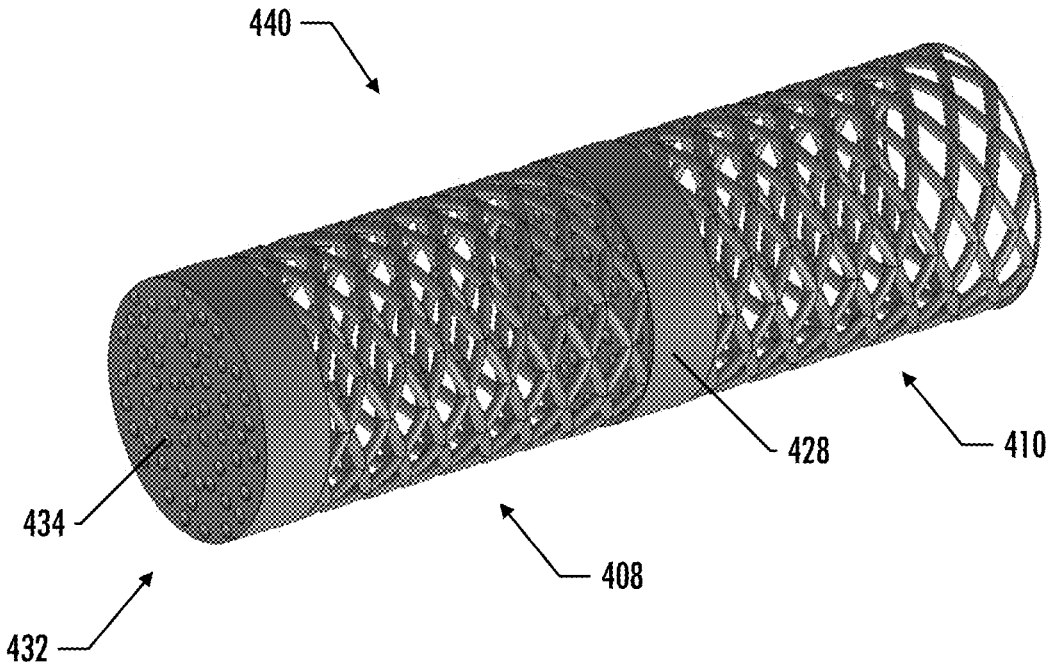
Figure 9B:
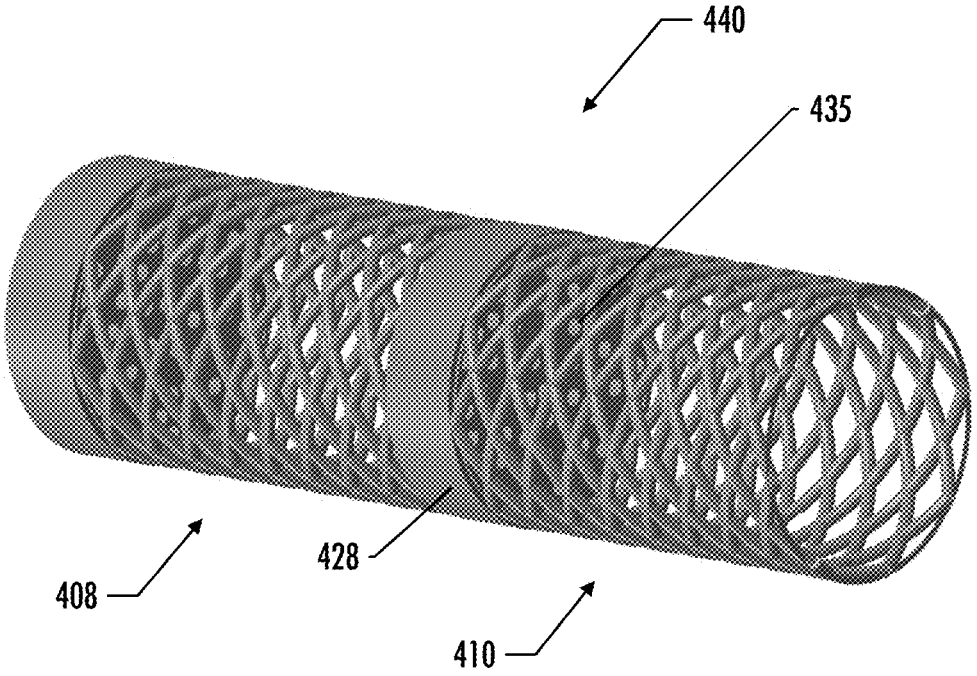
Figure 10:
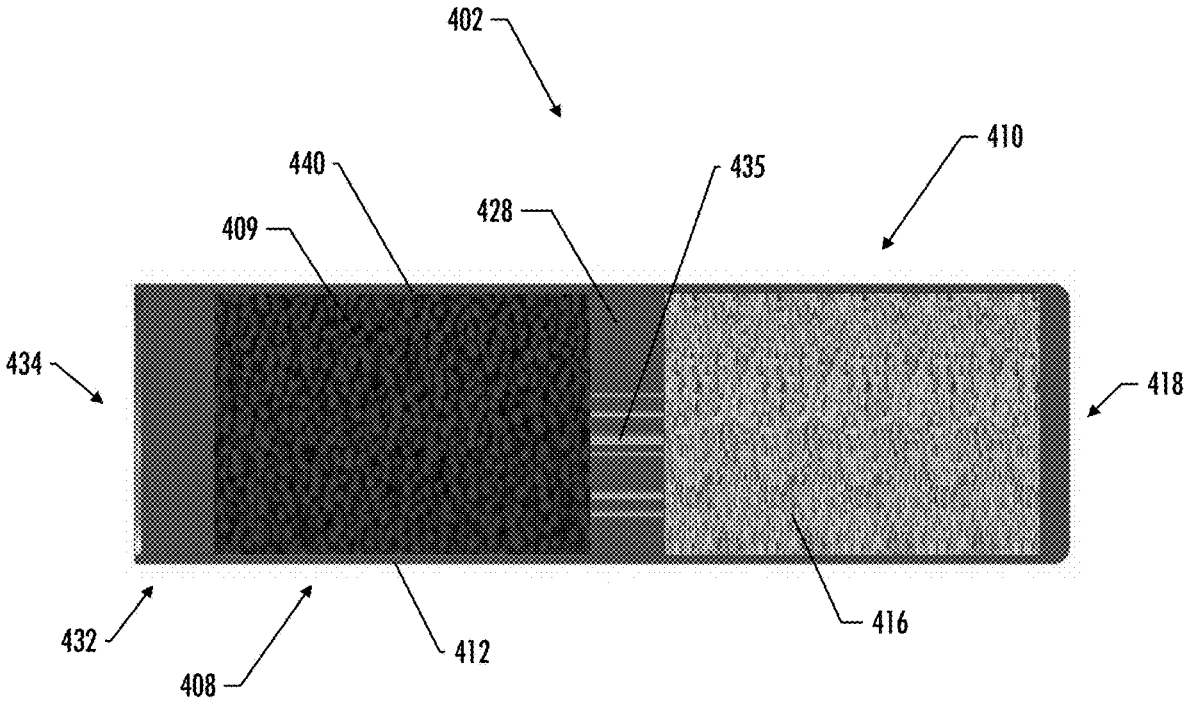
Figure 11A:
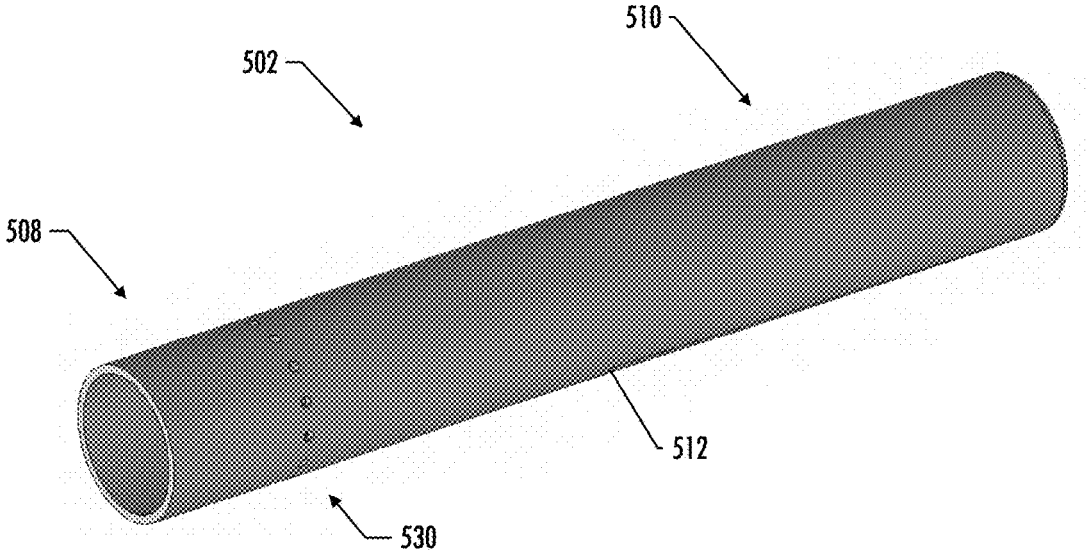
Figure 11B:
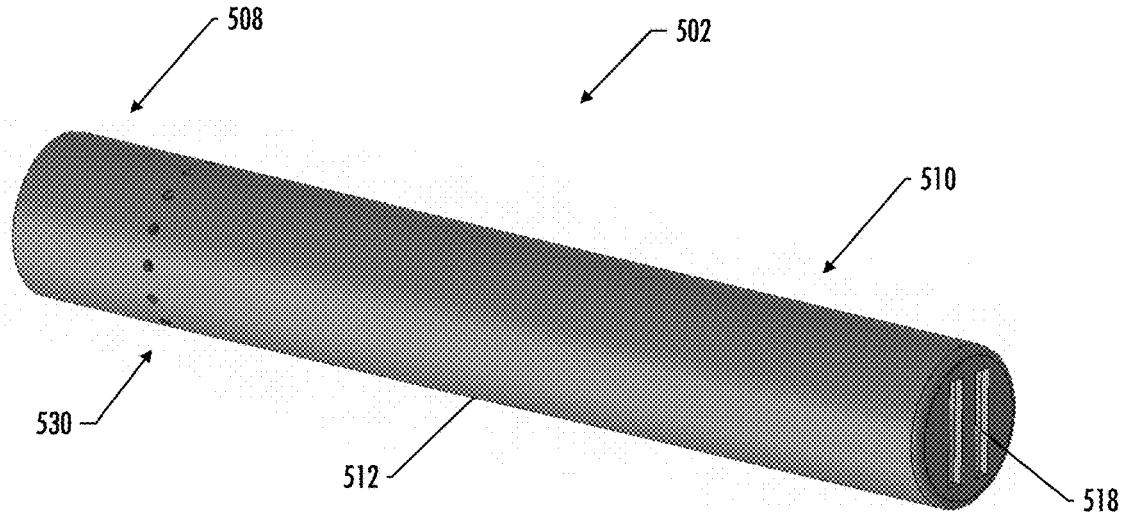
Figure 12:
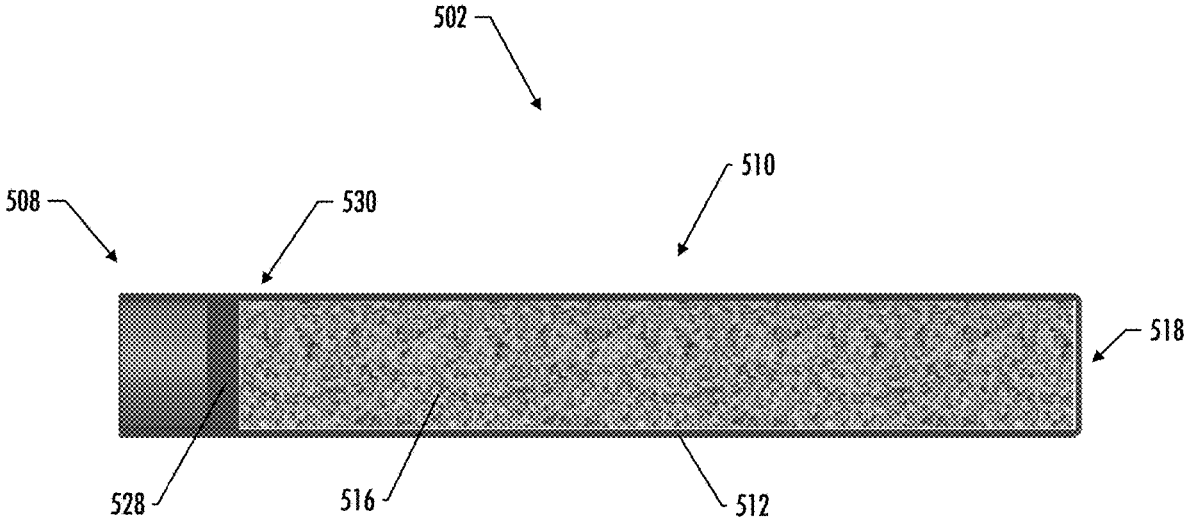
Figure 13A:
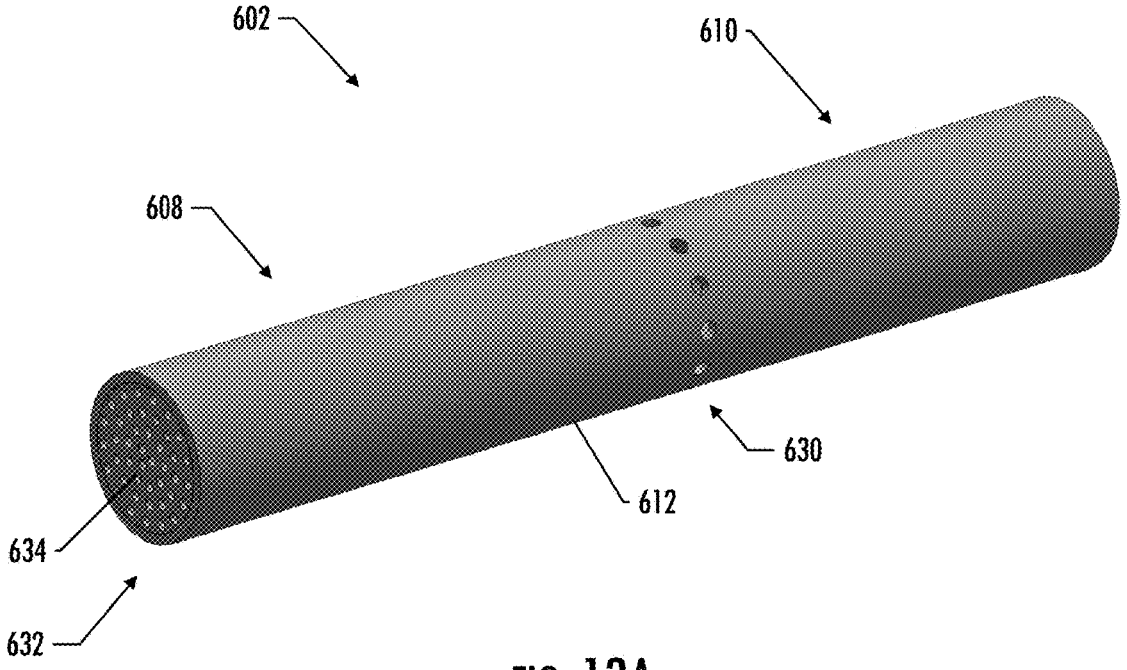
Figure 13B:
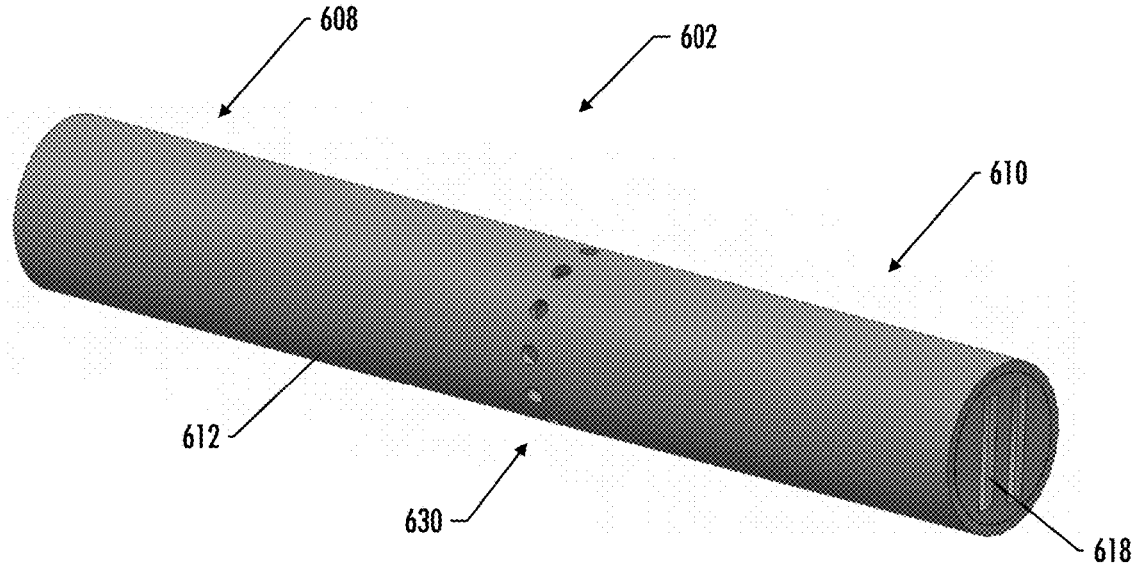
Figure 14:
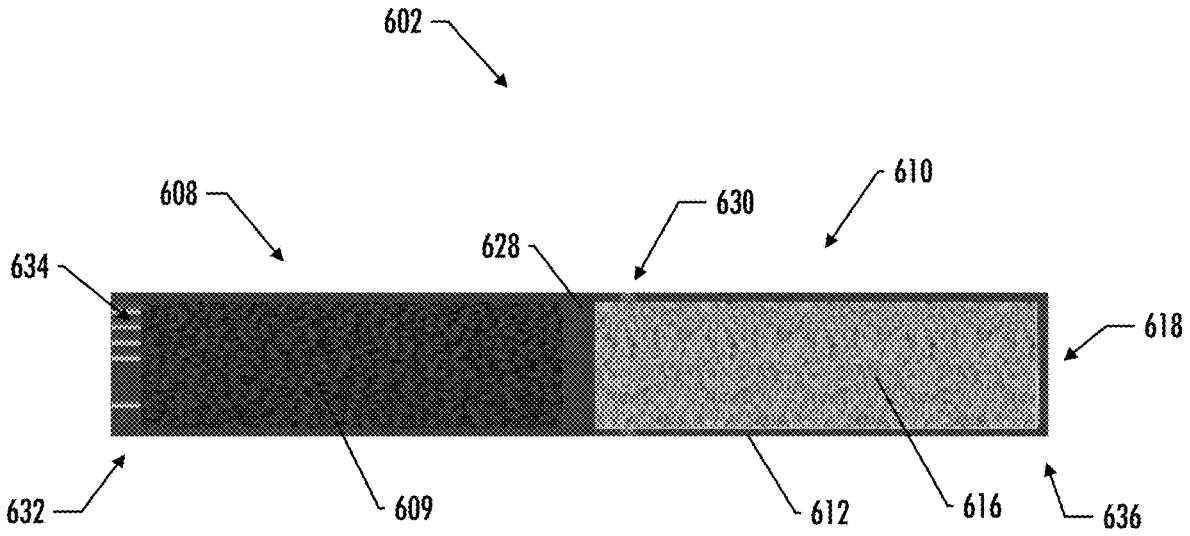
Figure 15A:
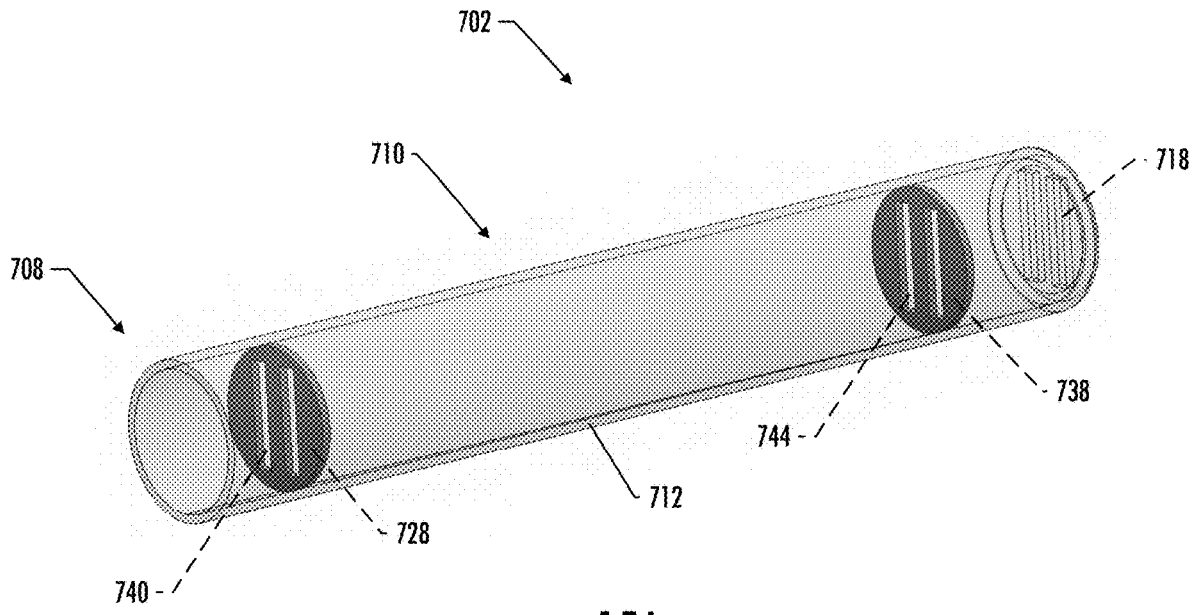
Figure 15B:
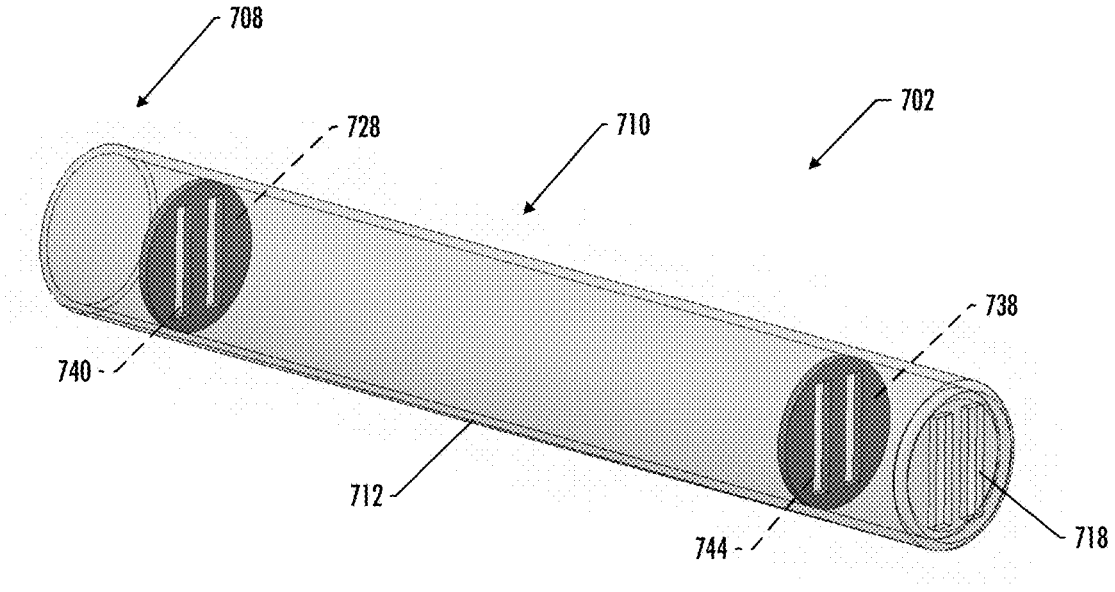
Figure 16:
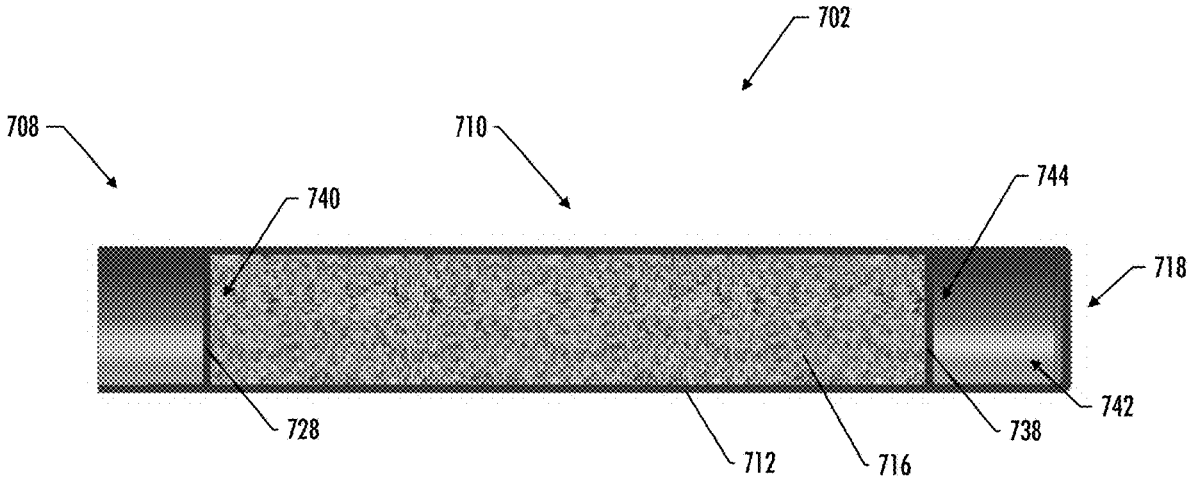
Figure 17A:
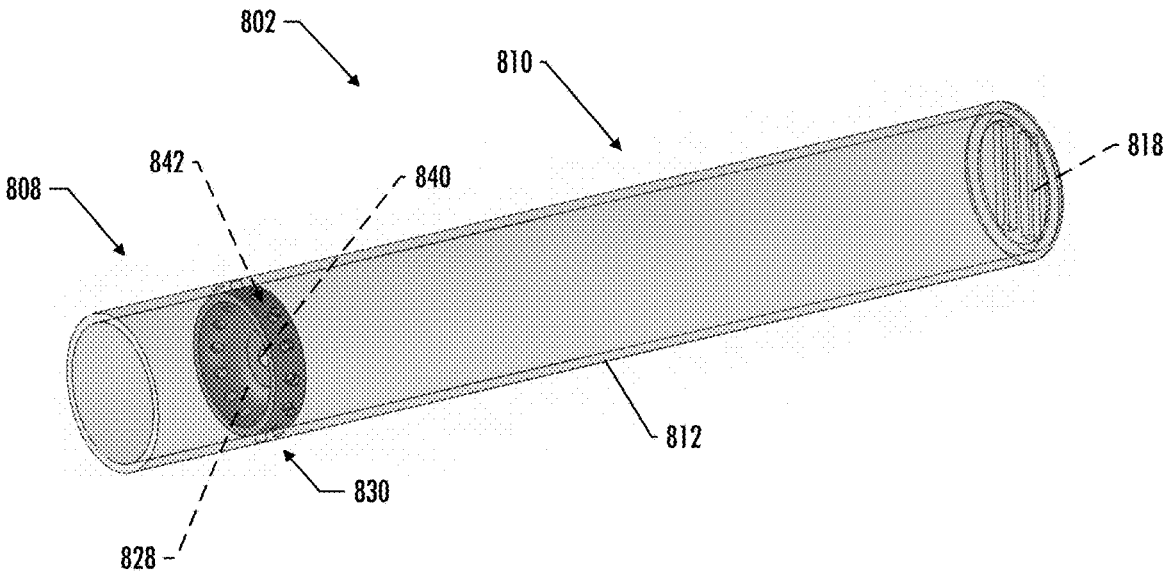
Figure 17B:
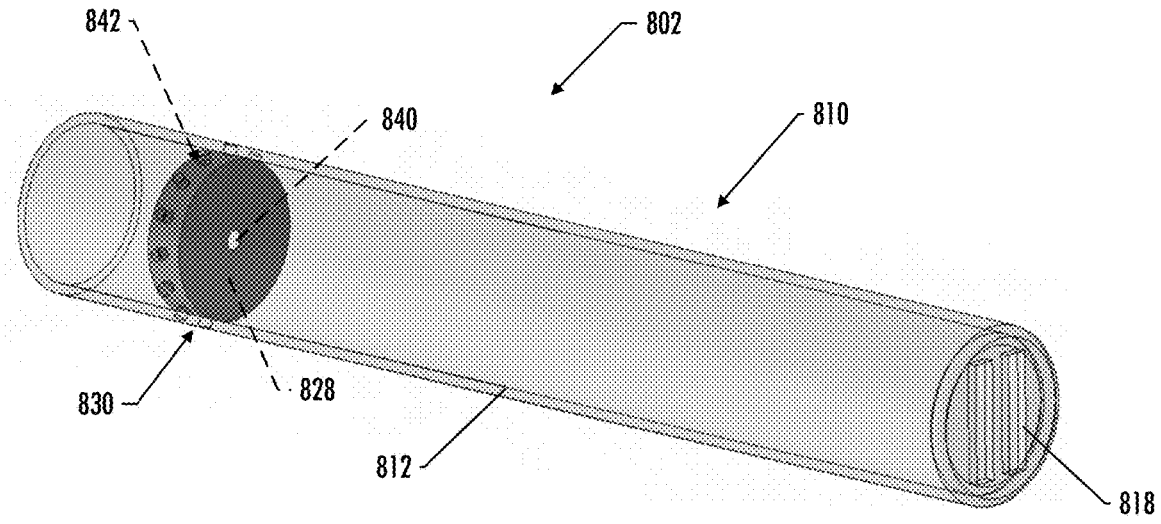
Figure 18:
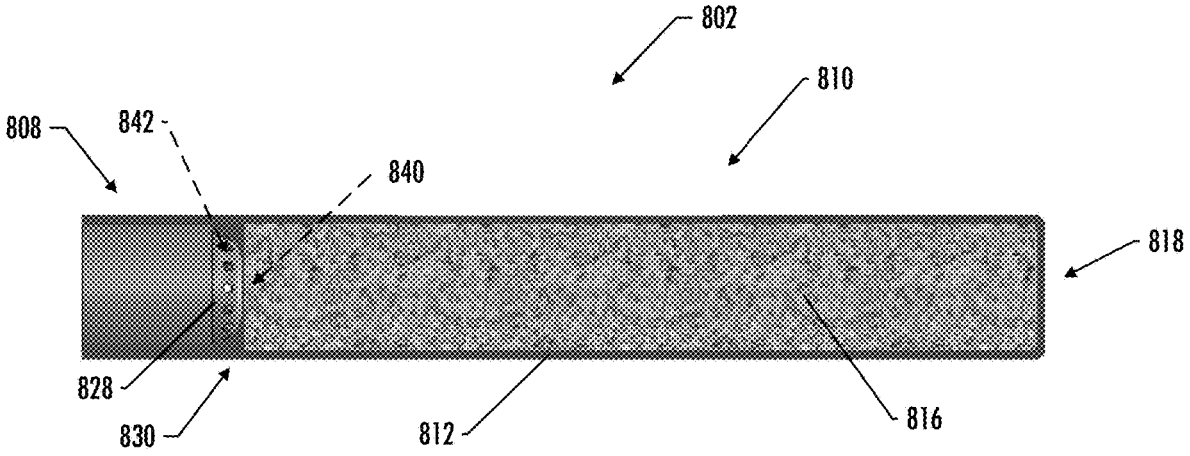
Figure 19A:
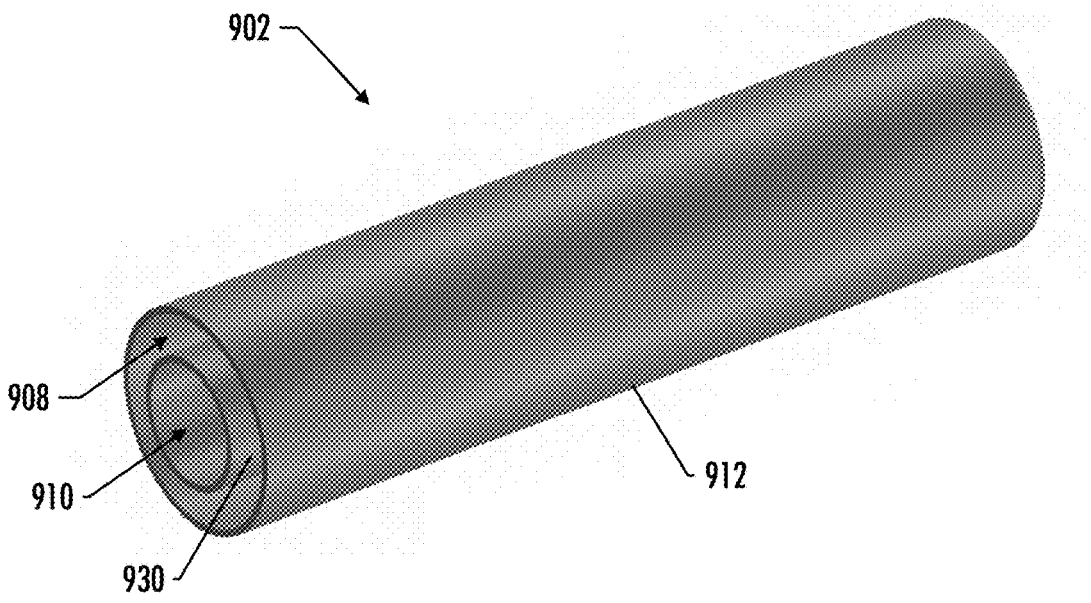
Figure 19B:
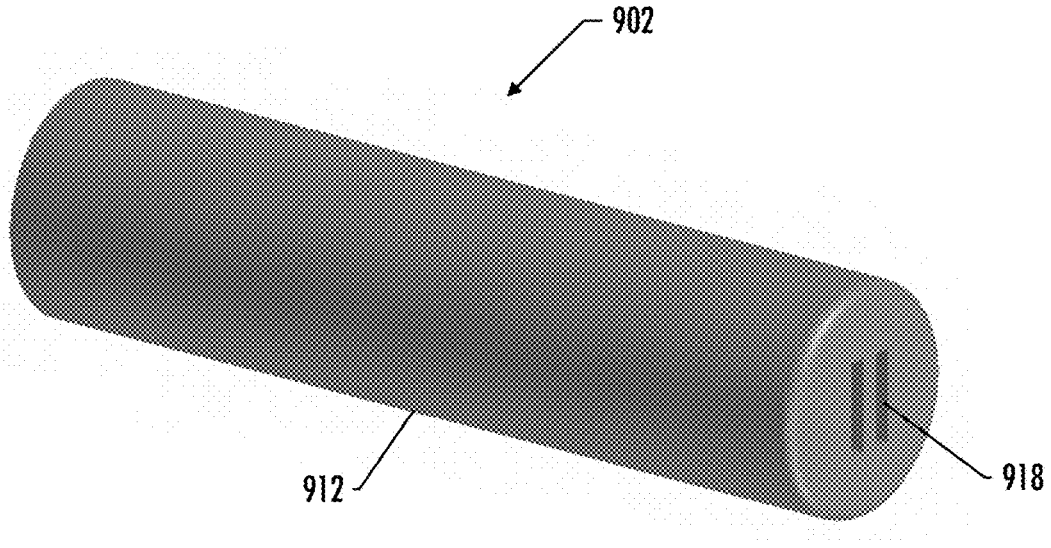
Figure 20:
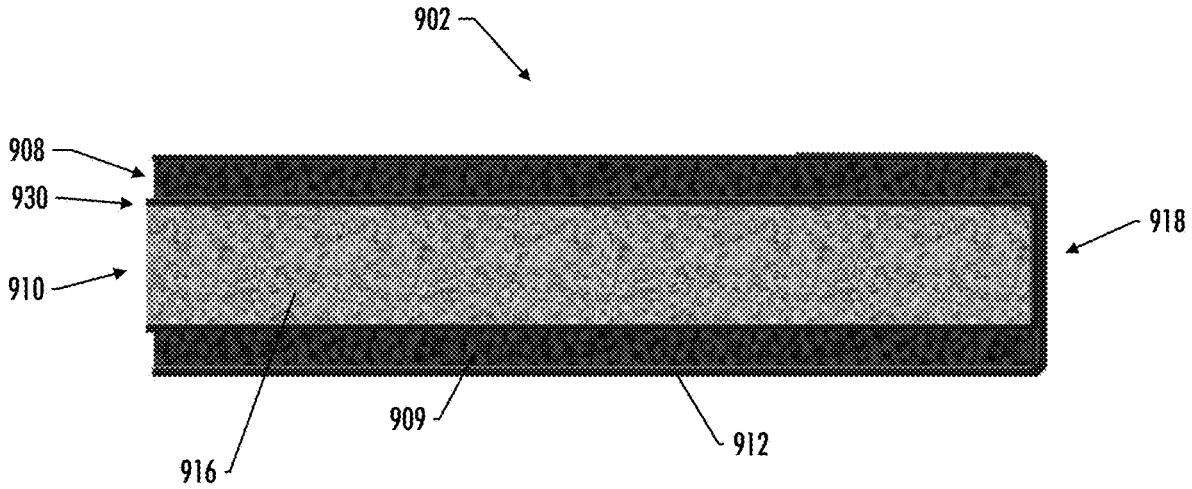
Figure 21A:
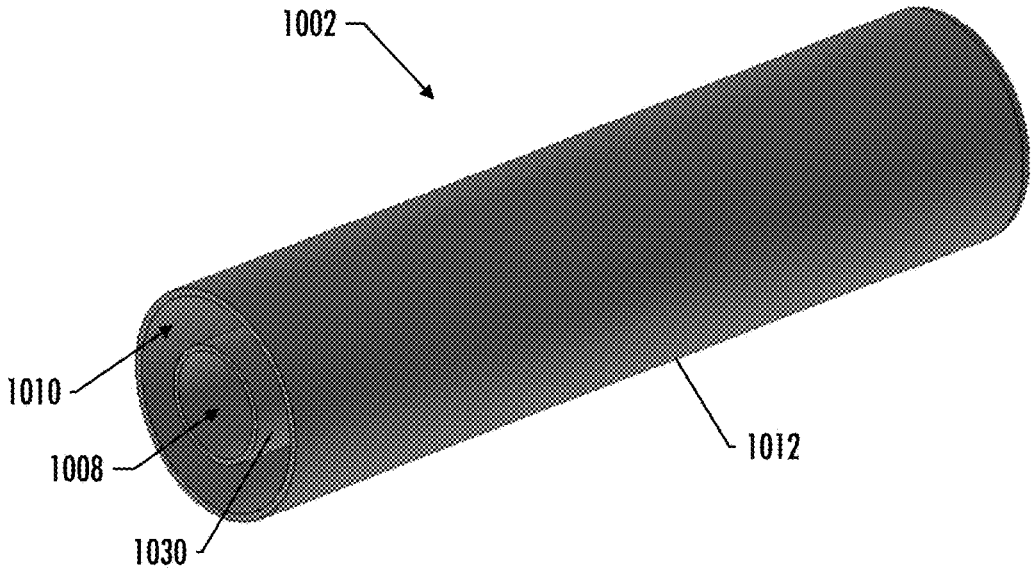
Figure 21B:
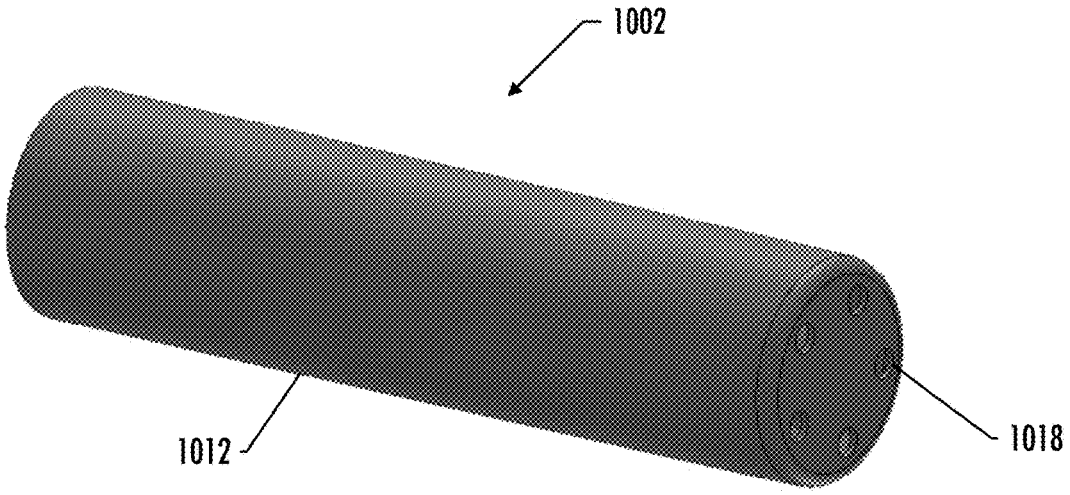
Figure 22:
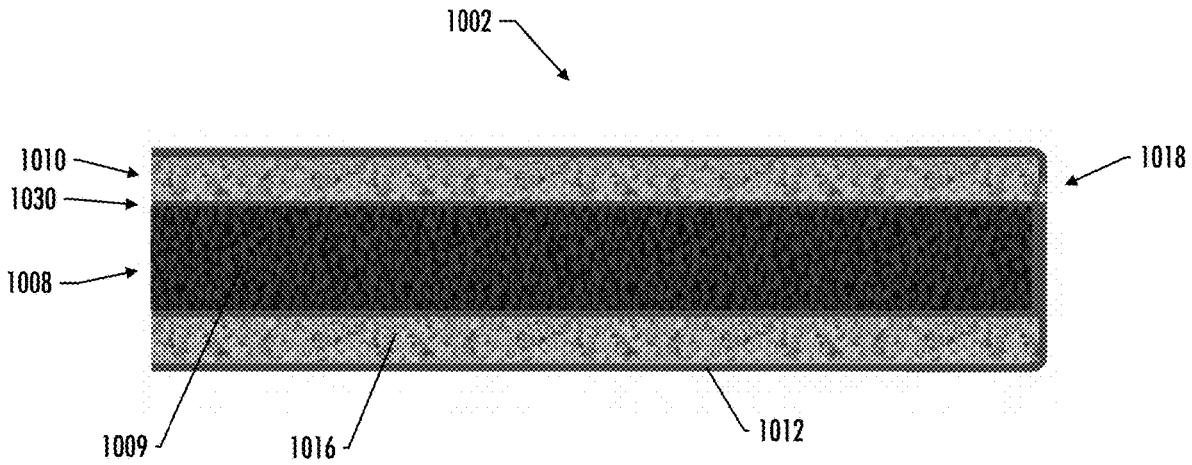
Figure 23A:
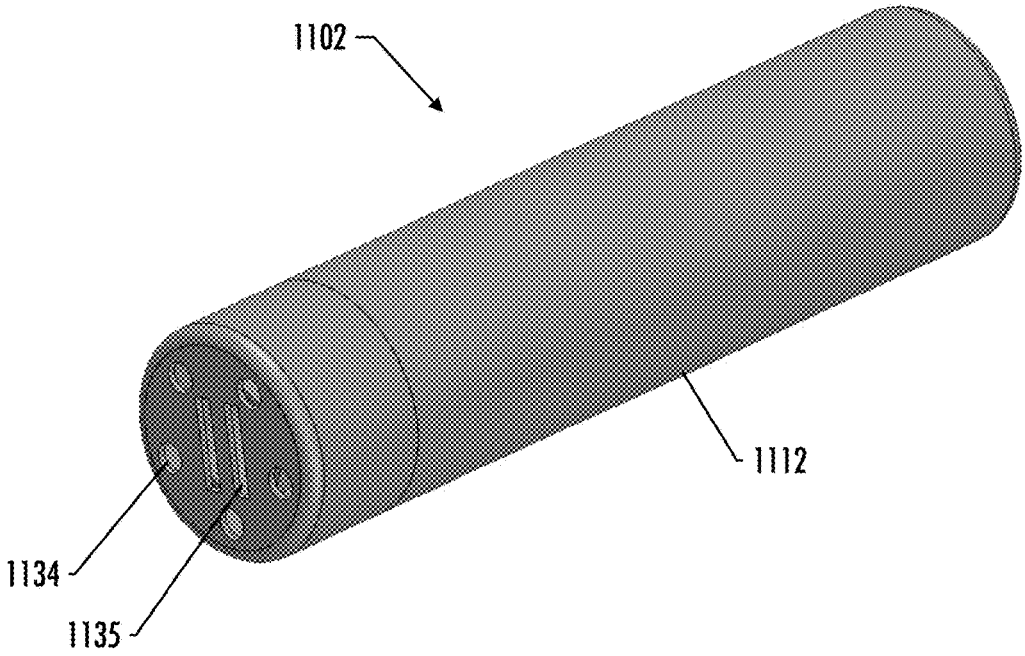
Figure 23B:
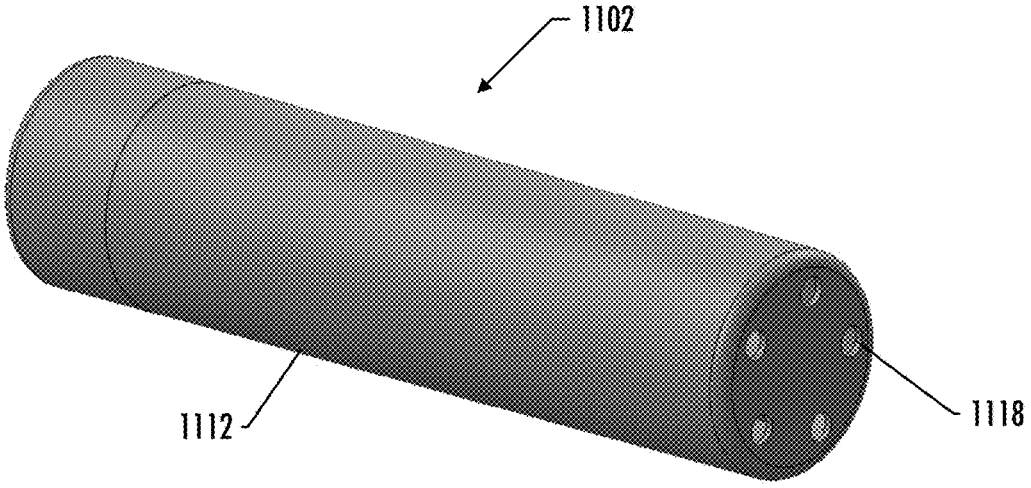
Figure 24:
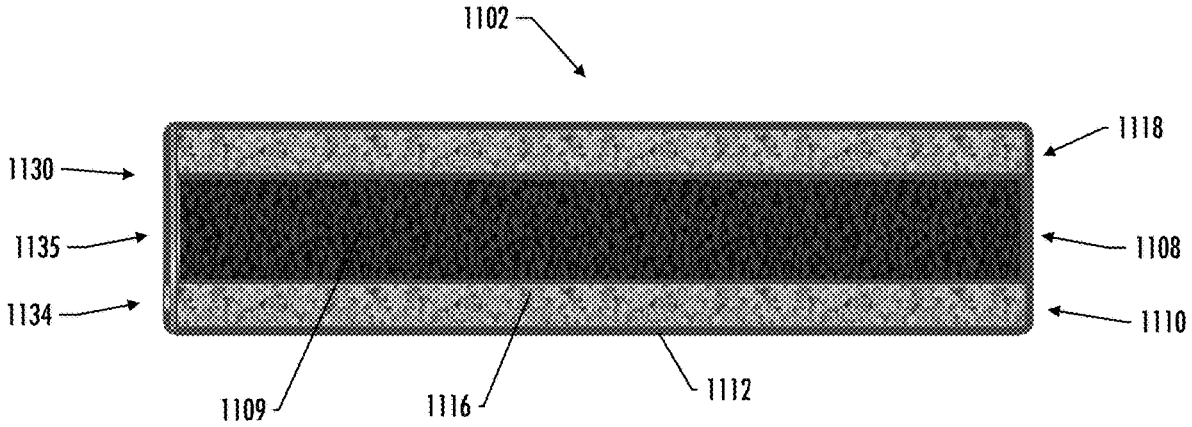

Having thus described the disclosure in the foregoing general terms, reference will now be made to the accompanying drawings, which are not necessarily drawn to scale, and wherein:

FIG. 1 illustrates a perspective view of an aerosol delivery device that includes a holder and a removable cartridge, according to one implementation of the present disclosure;

FIG. 2 illustrates a perspective view of a cartridge, according to one implementation of the present disclosure;

FIG. 3 illustrates a longitudinal cross-section view of the cartridge of FIG. 2, according to one implementation of the present disclosure;

FIG. 4A illustrates a perspective view of a cartridge, according to one implementation of the present disclosure;

FIG. 4B illustrates a reverse perspective view of the cartridge of FIG. 4A, according to one implementation of the present disclosure;

FIG. 5 illustrates a longitudinal cross-section view of the cartridge of FIGS. 4A and 4B, according to one implementation of the present disclosure;

FIG. 6A illustrates a perspective view of a cartridge, according to one implementation of the present disclosure;

FIG. 6B illustrates a reverse perspective view of the cartridge of FIG. 6A, according to one implementation of the present disclosure;

FIG. 7 illustrates a longitudinal cross-section view of the cartridge of FIGS. 6A and 6B, according to one implementation of the present disclosure;

FIG. 8A illustrates a perspective view of a cartridge, according to one implementation of the present disclosure;

FIG. 8B illustrates a reverse perspective view of the cartridge of FIG. 8A, according to one implementation of the present disclosure;

FIG. 9A illustrates a perspective view of the cartridge of FIG. 8A, with the outer housing removed, according to one implementation of the present disclosure;

FIG. 9B illustrates a reverse perspective view of the portion of the cartridge of FIG. 9A, according to one implementation of the present disclosure;

FIG. 10 illustrates a longitudinal cross-section view of the cartridge of FIGS. 8A and 8B, according to one implementation of the present disclosure;

FIG. 11A illustrates a perspective view of a cartridge, according to one implementation of the present disclosure;

FIG. 11B illustrates a reverse perspective view of the cartridge of FIG. 11A, according to one implementation of the present disclosure;

FIG. 12 illustrates a longitudinal cross-section view of the cartridge of FIGS. 11A and 11B, according to one implementation of the present disclosure;

FIG. 13A illustrates a perspective view of a cartridge, according to one implementation of the present disclosure;

FIG. 13B illustrates a reverse perspective view of the cartridge of FIG. 13A, according to one implementation of the present disclosure;

FIG. 14 illustrates a longitudinal cross-section view of the cartridge of FIGS. 13A and 13B, according to one implementation of the present disclosure;

FIG. 15A illustrates a perspective view of a cartridge, according to one implementation of the present disclosure;

FIG. 15B illustrates a reverse perspective view of the cartridge of FIG. 15A, according to one implementation of the present disclosure;

FIG. 16 illustrates a longitudinal cross-section view of the cartridge of FIGS. 15A and 15B, according to one implementation of the present disclosure;

FIG. 17A illustrates a perspective view of a cartridge, according to one implementation of the present disclosure;

FIG. 17B illustrates a reverse perspective view of the cartridge of FIG. 17A, according to one implementation of the present disclosure;

FIG. 18 illustrates a longitudinal cross-section view of the cartridge of FIGS. 17A and 17B, according to one implementation of the present disclosure;

FIG. 19A illustrates a perspective view of a cartridge, according to one implementation of the present disclosure;

FIG. 19B illustrates a reverse perspective view of the cartridge of FIG. 19A, according to one implementation of the present disclosure;

FIG. 20 illustrates a longitudinal cross-section view of the cartridge of FIGS. 19A and 19B, according to one implementation of the present disclosure;

FIG. 21A illustrates a perspective view of a cartridge, according to one implementation of the present disclosure;

FIG. 21B illustrates a reverse perspective view of the cartridge of FIG. 21A, according to one implementation of the present disclosure;

FIG. 22 illustrates a longitudinal cross-section view of the cartridge of FIGS. 21A and 21B, according to one implementation of the present disclosure;

FIG. 23A illustrates a perspective view of a cartridge, according to one implementation of the present disclosure;

FIG. 23B illustrates a reverse perspective view of the cartridge of FIG. 23A, according to one implementation of the present disclosure; and FIG. 24 illustrates a longitudinal cross-section view of the cartridge of FIGS. 23A and 23B, according to one implementation of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices. In preferred aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In preferred aspects, articles or devices characterized as smoking articles incorporate tobacco and/or components derived from tobacco.

As noted, aerosol generating components of certain preferred aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that component much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Smoking articles of the present disclosure generally include a number of elements provided or contained within an enclosure of some sort, such as a housing, an outer wrap, or wrapping, a casing, a component, a module, a member, or the like. The overall design of the enclosure is variable, and the format or configuration of the enclosure that defines the overall size and shape of the smoking article is also variable. In some, but not all implementations, the overall design, size, and/or shape of the enclosure resembles that of a conventional cigarette or cigar. Typically, an enclosure resembling the shape of a cigarette or cigar comprises separable components, members, or the like that are engaged to form the enclosure. For example, such a smoking article may comprise, in some aspects, separable components that include a holder and a cartridge that includes an aerosol delivery component (such as, for example, a substrate material) and a heat source component. In various aspects, the heat source may be capable of generating heat to aerosolize a substrate material that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. In some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations aerosol precursor composition-loaded porous beads/powders (ceramics) may be used. In other implementations, rods/cylinders made of extruded slurry of ceramic powder and aerosol precursor composition may be used.

According to certain aspects of the present disclosure, it may be advantageous to provide a smoking article that is easy to use and that provides reusable components. FIG. 1 illustrates a perspective view of such a smoking article, according to one implementation of the present disclosure. In particular, FIG. 1 illustrates a perspective view of a smoking article 100 that includes a removable cartridge 102 and a holder 104. The holder 104 includes a main body portion 120 and a mouthpiece portion 122 located at a mouth end of the holder 104. Although various implementations of holders may differ in the structure and manner in which a removable cartridge of the present disclosure is received, in the depicted implementation the removable cartridge 102 is configured to be longitudinally removably received into a cavity 106 defined on a receiving end of the main body portion 120 of the holder 104. Some examples of one or more holders that may be used in in conjunction with the removable cartridges of the present disclosure are described in U.S. patent application Ser. No. 16/035,103, filed on Jul. 13, 2018, and titled Smoking Article with Detachable Cartridge, which is incorporated herein by reference in its entirety.

FIG. 2 illustrates a perspective view of the removable cartridge 102 of FIG. 1, according to an example implementation of the present disclosure. In the depicted implementation, the removable cartridge 102 includes a heat portion 108 comprising a heat source 109, a substrate portion 110 comprising a substrate material 116 (see FIG. 3), and an outer housing 112 configured to circumscribe at least a portion of the heat source 109 and substrate material 116. It should be noted that although in the depicted implementation the cartridge 102 and the holder 104 have substantially cylindrical overall shapes, in various other implementations, any one or both of these components (and/or any of their subcomponents, such as, for example, the main body portion and/or the mouthpiece portion, of the holder, and/or the heat source, the outer housing, and/or the substrate material of the cartridge, may have a different shape. For example, in some implementations one or both of the holder or the cartridge (and/or any of their subcomponents) may have a substantially rectangular shape, such as a substantially rectangular cuboid shape. In other implementations, one or both of the holder or the cartridge (and/or any of their subcomponents) may have other hand-held shapes. For example, in some implementations the holder may have a small box shape, various pod mod shapes, or a fob-shape.

In various implementations, the heat source may be configured to generate heat upon ignition thereof. In the depicted implementation, the heat source 109 comprises a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible. Although specific dimensions of an applicable heat source may vary, in the depicted implementation, the heat source 109 has a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source 109 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Although in various implementations the heat source may have a variety of forms, including, for example, a substantially solid cylindrical shape or a hollow cylindrical (e.g., tube) shape, the heat source 109 of the depicted implementation comprises an extruded monolithic carbonaceous material that has a generally cylindrical shape that includes a plurality of internal passages 114 extending longitudinally from a first end of the heat source 109 to an opposing second end of the heat source 109. In the depicted implementation there are approximately thirteen internal passages 114 comprising a single central internal passage 114*a*, six surrounding internal passages 114*b*, which are spaced from the central internal passages 114*a* and have a similar size (e.g., diameter) to that of the central internal passage 114*a*, and six peripheral internal passages 114*c*, which are spaced from an outer surface of the heat source 109 and are smaller in diameter than that of the central internal passage 114*a*. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Although not depicted in the figures, some implementations may alternatively, or additionally, include one or more peripheral grooves that extend longitudinally from a first end of the heat source to an opposing second end, although in other implementations the grooves need not extend the full length of the heat source. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 3 illustrates a longitudinal cross-section view of the cartridge 102 of FIG. 1. As shown in the figure, the substrate material 116 of the depicted implementation has opposed first and second ends, with the heat source 109 disposed adjacent the first end of the substrate material 116. Although dimensions of the various components of the cartridge may vary due to the needs of a particular application, in the depicted implementation the cartridge 102 may have an overall length in an inclusive range of approximately 10 mm to approximately 50 mm and a diameter in an inclusive range of approximately 2 mm to approximately 20 mm. In addition, in the depicted implementation the housing 112 may have a thickness in the inclusive range of approximately 0.05 mm to 0.5 mm. Furthermore, in the depicted implementation the substrate material 116 may have a length in the inclusive range of approximately 5 mm to 50 mm and a diameter slightly less than that of the overall cartridge in order to accommodate the thickness of the housing 112, such as, for example, a diameter in an inclusive range of approximately 2.9 mm to approximately 9.9 mm.

In the depicted implementation, the substrate portion 110 comprises a substrate material 116 having a single segment, although in other implementations the substrate portion may include one or more additional substrate material segments. For example in some implementations, the smoking article 100 may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 116 of the depicted implementation).

Referring also to FIG. 1, ignition of the heat source 109 of the depicted implementation results in aerosolization of the aerosol precursor composition associated with the substrate material 116. In various implementations, the mouthpiece portion 122 is configured to receive the generated aerosol therethrough in response to a draw applied to the mouthpiece portion 122 by a user. In some implementations the mouthpiece portion 122 may comprise a filter configured to receive the aerosol therethrough in response to the draw applied to the mouthpiece portion 122. In various implementations, the filter may be provided, in some aspects, as a circular disc radially and/or longitudinally disposed proximate the end of the holder opposite the receiving end. In this manner, upon a draw on the mouthpiece portion 122, the filter may receive the aerosol flowing through holder 104 of the smoking article 100. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the smoking article 100 of the depicted implementation, the substrate material 116 comprises a plurality of tobacco beads together formed into a substantially cylindrical portion. In various implementations, however, the substrate material may comprise a variety of different compositions and combinations thereof, as explained in more detail below.

In one implementation, for example, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. patent application Ser. No. 15/905,320, filed on Feb. 26, 2018, and titled Heat Conducting Substrate For Electrically Heated Aerosol Delivery Device, which is incorporated herein by reference in its entirety.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., Fund. Appl. Toxicol., 39, p. 11-17 (1997); the disclosures of which are incorporated herein by reference in their entireties.

In still other implementations of the present disclosure, the substrate material may include an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethyl cellulose such as CMC 7HF and CMC 7H4F from Hercules Inc. Still other possible binder materials include starches (e.g., corn starch), guar gum, carrageenan, locust bean gum, pectins and xanthan gum. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material may include an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents. In various implementations, the extruded material may have one or more longitudinal openings.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 26% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally or alternatively, the substrate material may include an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure may include a substrate material comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as an aerosol precursor composition, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According to other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

In some implementations, the substrate material may comprise a liquid including an aerosol precursor composition and/or a gel including an aerosol precursor composition. Some examples of liquid compositions can be found in U.S. patent application Ser. No. 16/171,920, filed on Oct. 26, 2018, and titled Aerosol Delivery Device With Visible Indicator, which is incorporated herein by reference in its entirety.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The aerosol may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally or alternatively include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)).

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

In the depicted implementation, the substrate material 116 may comprise a centrally defined longitudinally extending axis between the opposed first and second ends, and a cross-section of the substrate material 116 may be, in some implementations, symmetrical about the axis. For example, in some implementations a cross-section of the substrate material 116 may be substantially circular such that the substrate material 116 defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements.

As shown in FIGS. 2 and 3, the cartridge 102 of the depicted implementation also includes an outer housing 112 configured to circumscribe at least a portion of the substrate portion 110, including the substrate material 116. In the depicted implementation, the outer housing 112 is also configured to circumscribe at least a portion of the heat source 109. In the depicted implementation, the outer housing comprises a rigid material. For example, the outer housing 112 of the depicted implementation is constructed of an aluminum material; however, in other implementations the outer housing 112 may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 112 is constructed as tube structure that substantially encapsulates the substrate material 116; however, as noted above, in other implementations the outer housing 112 may have other shapes. Although the shape of the outer housing 112 may vary, in the depicted implementation the outer housing 112 comprises a tube structure having an open end and a closed end. The depicted implementation of the outer housing 112 also includes one or more end apertures 118 located on the closed end of the outer housing 112 that are configured to allow aerosolized vapor (herein alternatively referred to as a "vapor" or "aerosol") to pass therethrough. The end apertures 118 of the depicted implementation are in the form of a pair of elongate rounded slots; however, in other implementations the end apertures may have any form that permits passage of the aerosol therethrough. As such, it will be appreciated that the end apertures 118 can comprise fewer or additional apertures and/or alternative shapes and sizes of apertures than those illustrated.

FIG. 4A illustrates a perspective view of a removable cartridge, according to another example implementation of the present disclosure, and FIG. 4B illustrates a reverse perspective view of the removable cartridge of FIG. 4A. In particular, FIGS. 4A and 4B illustrate perspective views of a removable cartridge 202. In the depicted implementation, the removable cartridge 202 includes a heat portion 208 comprising a heat source 209, a substrate portion 210 comprising a substrate material 216 (see FIG. 5), and an outer housing 212 configured to circumscribe at least a portion of the heat source 209 and substrate material 216.

It should be noted that although in the depicted implementation the cartridge 202 has a substantially cylindrical overall shape, in various other implementations, the cartridge or any of its subcomponents, such as, for example, the heat source, the outer housing, and/or the substrate material of the cartridge) may have different shapes. For example, in some implementations the cartridge (and/or any of its subcomponents) may have a substantially rectangular shape, such as a substantially rectangular cuboid shape. In other implementations, the cartridge (and/or any of their subcomponents) may have other shapes.

In various implementations, the heat source may be configured to generate heat upon ignition thereof. In the depicted implementation, the heat source 209 comprises a combustible fuel element that has a generally grooved cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. Combinations of heat sources are also possible.

The heat source 209 of the depicted implementation has a substantially cylindrical shape that includes a plurality of peripheral grooves 224 defined therethrough. In the depicted implementation, the grooves 224 extend longitudinally from a first end of the heat source to an opposing second end, although in other implementations the grooves need not extend the full length of the heat source. In some implementations, the grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source 209 has a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source 209 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 5 illustrates a longitudinal cross-section view of the cartridge 202 of FIGS. 4A and 4B. As shown in the figure, the substrate material 216 of the depicted implementation has opposed first and second ends, with the heat source 209 disposed adjacent the first end of the substrate material 216. Although dimensions of the various components of the cartridge may vary due to the needs of a particular application, in the depicted implementation the cartridge 202 may have an overall length in an inclusive range of approximately 10 mm to approximately 50 mm and a diameter in an inclusive range of approximately 2 mm to approximately 20 mm. In addition, in the depicted implementation the housing 212 may have a thickness in the inclusive range of approximately 0.05 mm to 0.5 mm. Furthermore, in the depicted implementation the substrate material 216 may have a length in the inclusive range of approximately 5 mm to 50 mm and a diameter slightly less than that of the overall cartridge in order to accommodate the thickness of the housing 212, such as, for example, a diameter in an inclusive range of approximately 2.9 mm to approximately 9.9 mm.

In the depicted implementation, the substrate portion 210 comprises a substrate material 216 having a single segment, although in other implementations the substrate portion may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 216 of the depicted implementation).

Ignition of the heat source 209 of the depicted implementation results in aerosolization of the aerosol precursor composition associated with the substrate material 216. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 216 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 216 may comprise a centrally defined longitudinally extending axis between the opposed first and second ends, and a cross-section of the substrate material 216 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements. As will be discussed in more detail below, in this and any other implementation described herein, one or more barriers may exist between the heat source and the substrate material.

As shown in FIG. 5, the outer housing 212 is configured to circumscribe at least a portion of the substrate portion 210, including the substrate material 216. In the depicted implementation, the outer housing 212 is also configured to circumscribe at least a portion of the heat source 209. In the depicted implementation, the outer housing comprises a rigid material. For example, the outer housing 212 of the depicted implementation is constructed of an aluminum material; however, in other implementations the outer housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 212 is constructed as tube structure that substantially encapsulates the substrate material 216; however, as noted above, in other implementations the outer housing 212 may have other shapes. Although the shape of the outer housing may vary, in the depicted implementation the outer housing 212 comprises a tube structure having an open end and a closed end. The depicted implementation of the outer housing 212 also includes one or more end apertures 218 (see FIG. 4B) located on the closed end of the outer housing 212 that are configured to allow aerosolized vapor (herein alternatively referred to as a "vapor" or "aerosol") to pass therethrough. The end apertures 218 of the depicted implementation are in the form of a pair of elongate rounded slots; however, in other implementations the end apertures may have any form that permits passage of the aerosol therethrough. As such, it will be appreciated that the end apertures 218 can comprise fewer or additional apertures and/or alternative shapes and sizes of apertures than those illustrated. FIG. 6A illustrates a perspective view of a removable cartridge, according to another example implementation of the present disclosure, and FIG. 6B illustrates a reverse perspective view of the removable cartridge of FIG. 6A. In particular, FIGS. 6A and 6B illustrate perspective views of a removable cartridge 302. In the depicted implementation, the removable cartridge 302 generally includes a heat portion 308 comprising a heat source 309 (shown transparent in the figures for illustration purposes), a substrate portion 310 comprising a substrate material 316 (see FIG. 7), and an outer housing 312 configured to circumscribe at least a portion of the heat source 309 and substrate material 316.

It should be noted that although in the depicted implementation the cartridge 302 has a substantially cylindrical overall shape, in various other implementations, the cartridge 302 or any of its subcomponents, such as, for example, the heat source 309, the outer housing 312, and/or the substrate material 316 of the cartridge 302) may have different shapes. For example, in some implementations the cartridge (and/or any of its subcomponents) may have a substantially rectangular shape, such as a substantially rectangular cuboid shape. In other implementations, the cartridge (and/or any of their subcomponents) may have other shapes.

In various implementations, the heat source may be configured to generate heat upon ignition thereof. In the depicted implementation, the heat source 309 comprises a combustible fuel element that has a generally grooved cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, and n-butane. Combinations of heat sources are also possible.

As noted above, the heat source 309 of the depicted implementation has a substantially cylindrical shape that includes a plurality of peripheral grooves 324 defined therethrough. In the depicted implementation, the grooves 324 extend longitudinally from a first end of the heat source to an opposing second end, although in other implementations the grooves need not extend the full length of the heat source. In some implementations, the grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source 309 has a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source 309 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 7 illustrates a longitudinal cross-section view of the cartridge 302 of FIGS. 6A and 6B. As shown in the figure, the substrate material 316 of the depicted implementation has opposed first and second ends. Although dimensions of the various components of the cartridge may vary due to the needs of a particular application, in the depicted implementation the cartridge 302 may have an overall length in an inclusive range of approximately 10 mm to approximately 50 mm and a diameter in an inclusive range of approximately 2 mm to approximately 20 mm. In addition, in the depicted implementation the housing 312 may have a thickness in the inclusive range of approximately 0.05 mm to 0.5 mm. Furthermore, in the depicted implementation the substrate material 316 may have a length in the inclusive range of approximately 5 mm to 50 mm and a diameter slightly less than that of the overall cartridge in order to accommodate the thickness of the housing 312, such as, for example, a diameter in an inclusive range of approximately 2.9 mm to approximately 9.9 mm.

In the depicted implementation, the substrate portion 310 comprises a substrate material 316 having a single segment, although in other implementations the substrate portion may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 316 of the depicted implementation).

Ignition of the heat source 309 of the depicted implementation results in aerosolization of the aerosol precursor composition associated with the substrate material 316. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 316 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 316 may comprise a centrally defined longitudinally extending axis between the opposed first and second ends, and a cross-section of the substrate material 316 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material 116 may be in axial alignment with adjacent elements.

In the depicted implementation, a barrier 328 exists between the second end of the heat source 309 and the first end of the substrate material 316. In particular, in the depicted implementation the barrier 328 separates the heat source 309 from the substrate material 316. In the depicted implementation, the barrier 328 comprises the same material as the outer housing 312; however, in other implementations the barrier may comprise a different material than the outer housing. For example, in some implementations the barrier may comprise a different metal material, a ceramic material, a plastic material, and/or any combination thereof. For example, in some implementations the barrier may be constructed of a metal material (such as, for example, stainless steel, aluminum, brass, copper, silver, gold, and bronze), or a graphite material, or a ceramic material, or a plastic material, or any combinations thereof. In other implementations, the barrier may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the barrier may comprise a glass material comprises one or more layers. In some implementations, in addition or alternatively, a heat transfer component may exist between the heat source and the substrate material. Examples of heat transfer components are described in U.S. patent application Ser. No. 15/923,735, filed on Mar. 16, 2018, and titled Smoking Article with Heat Transfer Component, which is incorporated herein by reference in its entirety.

In various implementations, the barrier may be substantially porous or substantially non-porous. In other implementations, the barrier may include one or more substantially porous portions and one or more substantially non-porous portions. In the depicted implementation, the barrier 328 comprises a porous barrier wall that includes a plurality of substantially cylindrical openings 330 disposed therethrough. Although in other implementations barrier openings may have different shapes and sizes (even within the same barrier), the plurality of openings disposed through the barrier wall of the depicted implementation have substantially the same size and shape. In the depicted implementation, the plurality of openings 330 form a substantially random pattern in the barrier 328, however, in other implementations the plurality of openings may form a pattern or may have random portions and patterned portions.

As shown in FIG. 7, the outer housing 312 is configured to circumscribe at least a portion of the substrate portion 310, including the substrate material 316. In the depicted implementation, the outer housing 312 is also configured to circumscribe at least a portion of the heat source 309. In the depicted implementation, the outer housing comprises a rigid material.

For example, the outer housing 312 of the depicted implementation is constructed of an aluminum material; however, in other implementations the outer housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 312 is constructed as tube structure that substantially encapsulates the substrate material 316; however, as noted above, in other implementations the outer housing may have other shapes. Although the shape of the outer housing may vary, in the depicted implementation the outer housing 312 comprises a tube structure having an open end and a closed end. The depicted implementation of the outer housing 312 also includes one or more end apertures 318 (see FIG. 6B) located on the closed end of the outer housing 312 that are configured to allow aerosolized vapor (herein alternatively referred to as a "vapor" or "aerosol") to pass therethrough. The end apertures 318 of the depicted implementation are in the form of a pair of elongate rounded slots; however, in other implementations the end apertures may have any form that permits passage of the aerosol therethrough. As such, it will be appreciated that the end apertures 318 can comprise fewer or additional apertures and/or alternative shapes and sizes of apertures than those illustrated.

FIG. 8A illustrates a perspective view of a removable cartridge, according to another example implementation of the present disclosure, and FIG. 8B illustrates a reverse perspective view of the removable cartridge of FIG. 8A. In particular, FIGS. 8A and 8B illustrate perspective views of a removable cartridge 402. In the depicted implementation, the removable cartridge 402 generally includes a heat portion 408 comprising a heat source 409, a substrate portion 410 comprising a substrate material 416, and an outer housing 412. The outer housing 412 of the depicted implementation includes an open end and a closed end. The depicted implementation of the outer housing 412 also includes one or more end apertures 418 located on the closed end of the outer housing 412 that are configured to allow aerosolized vapor (herein alternatively referred to as a "vapor" or "aerosol") to pass therethrough. The end apertures 418 of the depicted implementation are in the form of a pair of elongate rounded slots; however, in other implementations the end apertures may have any form that permits passage of the aerosol therethrough. As will be discussed in more detail below, the depicted implementation further includes an intermediate housing 440 (see FIGS. 9A and 9B) having a closed end and an open and that includes the heat portion 408 comprising the heat source 409 and the substrate portion 410 comprising the substrate material 416. As such, it will be appreciated that the end apertures 418 can comprise fewer or additional apertures and/or alternative shapes and sizes of apertures than those illustrated.

FIG. 9A illustrates a perspective view of the cartridge of FIG. 8A, with the outer housing removed, according to one implementation of the present disclosure, and FIG. 9B illustrates a reverse perspective view of the portion of the cartridge of FIG. 9A. In particular, FIGS. 9A and 9B illustrate the intermediate housing 440 that includes the heat portion 408 comprising the heat source 409 and the substrate portion 410 comprising the substrate material 416 (see FIG. 10). In the depicted implementation, the intermediate housing 440 includes a closed end 432 and an open end, the closed end 432 being substantially porous and including a plurality of openings 434 defined therethrough. Although other implementations may differ, in the depicted implementation the plurality of openings 434 are substantially randomly distributed across the closed end. In other implementations the plurality of openings may form a pattern or may have random portions and patterned portions. Further, the plurality of openings 434 of the depicted implementation comprises a plurality of substantially cylindrical openings. Although in other implementations the openings may have different shapes and sizes (even within the same intermediate housing), the plurality of openings 434 of the depicted implementation have substantially the same size and shape. In the depicted implementation, the outer housing 412 is configured to circumscribe the intermediate housing 440 such that when assembled, the respective closed ends of the intermediate housing 440 and outer housing 412 are located on opposite ends of the cartridge 402. In the depicted implementation, the intermediate housing 440 comprises a mesh enclosure; however, in other implementations the intermediate housing may have other configurations.

In the depicted implementation, the heat source 409 comprises a plurality of ignitable objects, such as, for example, a plurality of ignitable beads. In other implementations, the heat source may comprise a unity element that incorporates a combustible carbonaceous material, such as, for example a combustible fuel element. In some implementations, the fuel element may have a shape that substantially matches the shape of the heat portion of the intermediate housing (e.g., in some implementations, a substantially cylindrical shape), although in other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source 409 has a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

In various implementations, the heat source may be constructed in a variety of ways, for example, in some implementations the heat source may be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

Although in the depicted implementation the cartridge 402 has a substantially cylindrical overall shape, in various other implementations, the cartridge, or any of its subcomponents, may have other shapes. For example, in some implementations the cartridge (and/or any of its subcomponents) may have a substantially rectangular shape, such as a substantially rectangular cuboid shape. In other implementations, the cartridge (and/or any of their subcomponents) may have other shapes.

FIG. 10 illustrates a longitudinal cross-section view of the cartridge 402 of FIGS. 9A and 9B. Although dimensions of the various components of the cartridge 402 may vary due to the needs of a particular application, in the depicted implementation the cartridge 402 may have an overall length in an inclusive range of approximately 10 mm to approximately 50 mm and a diameter in an inclusive range of approximately 2 mm to approximately 20 mm. In addition, in the depicted implementation the outer housing 412 may have a thickness in the inclusive range of approximately 0.05 mm to 0.5 mm. Furthermore, in the depicted implementation the substrate material 116 may have a length in the inclusive range of approximately 5 mm to 50 mm and a diameter slightly less than that of the overall cartridge in order to accommodate the thickness of the housing 312, such as, for example, a diameter in an inclusive range of approximately 2.9 mm to approximately 9.9 mm.

In the depicted implementation, the substrate portion 410 comprises a substrate material 416 having a single segment, although in other implementations the substrate portion may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 416 of the depicted implementation).

Ignition of the heat source 409 of the depicted implementation results in aerosolization of the aerosol precursor composition associated with the substrate material 416. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 416 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 416 may comprise a centrally defined longitudinally extending axis between the opposed first and second ends, and a cross-section of the substrate material 416 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements.

In the depicted implementation, a barrier 428 separates the heat source 409 from the substrate material 416. In the depicted implementation, the barrier 428 comprises the same material as the intermediate housing 440; however, in other implementations the barrier may comprise a different material than the outer housing. For example, in some implementations the barrier may comprise a different metal material, a ceramic material, a plastic material, and/or any combination thereof. For example, in some implementations the barrier may be constructed of a metal material (such as, for example, stainless steel, aluminum, brass, copper, silver, gold, and bronze), or a graphite material, or a ceramic material, or a plastic material, or any combinations thereof. In other implementations, the barrier may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the barrier may comprise a glass material comprises one or more layers. In some implementations, in addition or alternatively, a heat transfer component may exist between the heat source and the substrate material. Examples of heat transfer components are described in U.S. patent application Ser. No. 15/923,735, filed on Mar. 16, 2018, and titled Smoking Article with Heat Transfer Component, which is incorporated herein by reference in its entirety.

In various implementations, the barrier may be substantially porous or substantially non-porous. In other implementations, the barrier may include one or more substantially porous portions and one or more substantially non-porous portions. In the depicted implementation, the barrier 428 comprises a substantially porous barrier wall that includes a plurality of substantially cylindrical openings 435 disposed therethrough. Although in other implementations barrier openings may have different shapes and sizes (even within the same barrier), the plurality of openings disposed through the barrier wall of the depicted implementation have substantially the same size and shape. Although other implementations may differ, in the depicted implementation the plurality of openings 435 are substantially randomly distributed across the barrier 435. In other implementations, the plurality of openings may form a pattern or may have random portions and patterned portions.

As shown in FIG. 10, the outer housing 412 of the depicted implementation is configured to circumscribe the intermediate housing 440, which includes the heat portion 408 comprising the heat source 409 and the substrate portion 410 comprising the substrate material 416. In the depicted implementation, the outer housing 412 comprises a rigid material. For example, the outer housing 412 of the depicted implementation is constructed of an aluminum material; however, in other implementations the outer housing 412 may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the intermediate housing 440 also comprises a rigid material, which may be the same material as the outer housing 412 (e.g., in the depicted implementation, aluminum). In other implementations, the outer housing and/or the intermediate housing may be made of different materials. In various implementations, the intermediate housing may be made of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 412 and the intermediate housing 440 are constructed tube structures; however, as noted above, in other implementations the outer housing and/or the intermediate housing may have other shapes.

FIG. 11A illustrates a perspective view of a removable cartridge, according to another example implementation of the present disclosure, and FIG. 11B illustrates a reverse perspective view of the removable cartridge of FIG. 11A. In particular, FIGS. 11A and 11B illustrate perspective views of a removable cartridge 502. In the depicted implementation, the removable cartridge 502 generally includes a heat portion 508 comprising a heat source (not shown for illustration purposes), a substrate portion 510 comprising a substrate material 516, and an outer housing 512 configured to circumscribe at least a portion of the heat source and substrate material 516.

In the depicted implementation, the outer housing 512 includes at least one opening 530 located proximate the substrate portion 510 and defined circumferentially around at least a portion of the outer housing 512. In particular, the depicted implementation defines a series of substantially evenly spaced openings 530 that extend through the outer housing 512 and are disposed around the entire circumference of the outer housing 512. In the depicted implementation, the openings 530 are defined on the substrate portion side of the outer housing 512 and proximate the barrier 528 (see FIG. 12, described below). In the depicted implementation, the openings 530 may be configured to allow air to be drawn into the cartridge 502 and through the substrate material 516. In such a manner, the air drawn through the openings 530 may be mixed with the generated aerosol. In various implementations, such openings may allow a heat source to be separated from the substrate material by a substantially non-porous barrier. In such a manner, drawn air may not flow through the heat source. It should be noted however, that in other implementations a substantially porous barrier may also be used.

Although the openings 530 of the depicted implementation have a substantially cylindrical shape, in other implementations the openings may have any shape. In the depicted implementations, there are approximately fourteen openings; however, in other implementations there may be any number of openings, including as few as one, and although in the depicted implementation the plurality of openings have substantially the same size and shape, in other implementations the openings may have different shapes and/or sizes.

It should be noted that although in the depicted implementation the cartridge 502 has a substantially cylindrical overall shape, in various other implementations, the cartridge or any of its subcomponents, may have other shapes. For example, in some implementations the cartridge (and/or any of its subcomponents) may have a substantially rectangular shape, such as a substantially rectangular cuboid shape. In other implementations, the cartridge (and/or any of their subcomponents) may have other shapes.

In various implementations, the heat source may be configured to generate heat upon ignition thereof. In the depicted implementation, the heat source may comprise a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, and n-butane. Combinations of heat sources are also possible.

In some implementations, the heat source may include a plurality of peripheral grooves defined therethrough. In some implementations, the grooves may extend longitudinally from a first end of the heat source to an opposing second end, although in other implementations the grooves need not extend the full length of the heat source. In some implementations, the grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source may have a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source may be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 12 illustrates a longitudinal cross-section view of the cartridge 502 of FIGS. 11A and 11B. As shown in the figure, the substrate portion 510 of the depicted implementation has opposed first and second ends. Although dimensions of the various components of the cartridge 502 may vary due to the needs of a particular application, in the depicted implementation the cartridge 502 may have an overall length in an inclusive range of approximately 10 mm to approximately 10 mm and a diameter in an inclusive range of approximately 2 mm to approximately 20 mm. In addition, in the depicted implementation the housing 512 may have a thickness in the inclusive range of approximately 0.05 mm to 0.5 mm. Furthermore, in the depicted implementation the substrate material 516 may have a length in the inclusive range of approximately 5 mm to 50 mm and a diameter slightly less than that of the overall cartridge in order to accommodate the thickness of the housing 512, such as, for example, a diameter in an inclusive range of approximately 2.9 mm to approximately 9.9 mm.

As shown in the figure, the outer housing 512 is configured to circumscribe at least a portion of the substrate portion 510 comprising the substrate material 516. In the depicted implementation, the outer housing 512 is also configured to circumscribe at least a portion of the heat source. In the depicted implementation, the outer housing 512 comprises a rigid material.

For example, the outer housing 512 of the depicted implementation is constructed of an aluminum material; however, in other implementations the outer housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 512 is constructed as tube structure that substantially encapsulates the substrate material 516; however, as noted above, in other implementations the outer housing 512 may have other shapes. Although the shape of the outer housing 512 may vary, in the depicted implementation the outer housing 312 comprises a tube structure having an open end and a closed end. The depicted implementation of the outer housing 512 also includes one or more end apertures 518 (see FIG. 11B) located on the closed end of the outer housing 512 that are configured to allow aerosolized vapor (herein alternatively referred to as a "vapor" or "aerosol") to pass therethrough. The end apertures 518 of the depicted implementation are in the form of a pair of elongate rounded slots; however, in other implementations the end apertures may have any form that permits passage of the aerosol therethrough. As such, it will be appreciated that the end apertures 518 can comprise fewer or additional apertures and/or alternative shapes and sizes of apertures than those illustrated.

In the depicted implementation, the substrate portion 510 comprises a substrate material 516 having a single segment, although in other implementations the substrate portion 510 may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 516 of the depicted implementation).

Ignition of the heat source of the depicted implementation results in aerosolization of the aerosol precursor composition associated with the substrate material 516. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable.

For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 516 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 516 may comprise a centrally defined longitudinally extending axis between the opposed first and second ends, and a cross-section of the substrate material 516 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material 516 may comprise an asymmetric cross-section about the axis. In various implementations, each end of the substrate material may be in axial alignment with adjacent elements.

In the depicted implementation, a barrier 528 exists between the second end of the heat source and the first end of the substrate material 516. In particular, in the depicted implementation the barrier 528 separates the heat source from the substrate material 516. In the depicted implementation, the barrier 528 comprises the same material as the outer housing 512; however, in other implementations the barrier may comprise a different material than the outer housing. For example, in some implementations the barrier may comprise a different metal material, a ceramic material, a plastic material, and/or any combination thereof. For example, in some implementations the barrier may be constructed of a metal material (such as, for example, stainless steel, aluminum, brass, copper, silver, gold, and bronze), or a graphite material, or a ceramic material, or a plastic material, or any combinations thereof. In other implementations, the barrier may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the barrier may comprise a glass material comprises one or more layers. In some implementations, in addition or alternatively, a heat transfer component may exist between the heat source and the substrate material. Examples of heat transfer components are described in U.S. patent application Ser. No. 15/923,735, filed on Mar. 16, 2018, and titled Smoking Article with Heat Transfer Component, which is incorporated herein by reference in its entirety.

In various implementations, the barrier may be substantially porous or substantially non-porous. In other implementations, the barrier may include one or more substantially porous portions and one or more substantially non-porous portions. In the depicted implementation, the barrier 528 comprises a substantially solid, non-porous barrier wall. In such a manner, during a draw air enters the substrate material 516 through the plurality of openings 530.

FIG. 13A illustrates a perspective view of a removable cartridge, according to another example implementation of the present disclosure, and FIG. 13B illustrates a reverse perspective view of the removable cartridge of FIG. 13A. In particular, FIGS. 13A and 13B illustrate perspective views of a removable cartridge 602. In the depicted implementation, the removable cartridge 602 generally includes a heat portion 608 comprising a heat source 609, a substrate portion 610 comprising a substrate material 616, and an outer housing 612 configured to circumscribe at least a portion of the heat source 609 and substrate material 616.

In the depicted implementation, the outer housing 612 includes at least one opening 630 located proximate the substrate portion 610 and defined circumferentially around at least a portion of the outer housing 612. In particular, the depicted implementation defines a series of substantially evenly spaced openings 630 that extend through the outer housing and are disposed around the entire circumference of the outer housing 612. In the depicted implementation, the openings 630 are defined on the substrate portion side of the outer housing 612 and proximate the barrier 628 (see FIG. 14, described below). In the depicted implementation, the openings 630 may be configured to allow air to be drawn into the cartridge 602 and through the substrate material 616. In such a manner, the air drawn through the openings 630 may be mixed with the generated aerosol. In various implementations, such openings may allow a heat source to be separated from the substrate material by a substantially non-porous barrier. In such a manner, drawn air may not flow through the heat source. It should be noted however, that in other implementations a substantially porous barrier may also be used.

Although the openings 630 of the depicted implementation have a substantially cylindrical shape, in other implementations the openings may have any shape. In the depicted implementations, there are approximately fourteen openings; however, in other implementations there may be any number of openings, including as few as one. Although in the depicted implementation the plurality of openings have substantially the same size and shape, in other implementations the openings may have different shapes and/or sizes.

It should be noted that although in the depicted implementation the cartridge 602 has a substantially cylindrical overall shape, in various other implementations, the cartridge 602 or any of its subcomponents, may have other shapes. For example, in some implementations the cartridge (and/or any of its subcomponents) may have a substantially rectangular shape, such as a substantially rectangular cuboid shape. In other implementations, the cartridge (and/or any of their subcomponents) may have other shapes.

In the depicted implementation, the heat source 609 comprises a plurality of ignitable objects, such as, for example, a plurality of ignitable beads. In other implementations, the heat source may comprise a unity element that incorporates a combustible carbonaceous material, such as, for example a combustible fuel element. In some implementations, the fuel element may have a shape that substantially matches the shape of the heat portion of the outer housing 612 (e.g., in some implementations, a substantially cylindrical shape), although in other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, and n-butane. Combinations of heat sources are also possible.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source may have a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source may be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 14 illustrates a longitudinal cross-section view of the cartridge 602 of FIGS. 13A and 13B. As shown in the figure, the substrate material 616 of the depicted implementation has opposed first and second ends. Although dimensions of the various components of the cartridge may vary due to the needs of a particular application, in the depicted implementation the cartridge 602 may have an overall length in an inclusive range of approximately 10 mm to approximately 50 mm and a diameter in an inclusive range of approximately 2 mm to approximately 20 mm. In addition, in the depicted implementation the housing 612 may have a thickness in the inclusive range of approximately 0.05 mm to 0.5 mm. Furthermore, in the depicted implementation the substrate material 616 may have a length in the inclusive range of approximately 5 mm to 50 mm and a diameter slightly less than that of the overall cartridge in order to accommodate the thickness of the housing, such as, for example, a diameter in an inclusive range of approximately 2.9 mm to approximately 9.9 mm.

As shown in the figure, the outer housing 612 is configured to circumscribe the substrate portion 610, including the substrate material 616, and the heat portion 608, including the heat source 609. In the depicted implementation, the outer housing comprises a rigid material. For example, the outer housing 612 of the depicted implementation is constructed of an aluminum material; however, in other implementations the outer housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 612 is constructed as tube structure that substantially encapsulates the substrate material 616 and the heat source 609; however, as noted above, in other implementations the outer housing may have other shapes. Although the shape of the outer housing may vary, in the depicted implementation the outer housing 612 comprises a tube structure having a pair of opposite substantially porous closed ends 632, 636. In the depicted implementation, end 632 of the outer housing 612 proximate the heat portion 608 includes a plurality of openings 634 defined therethrough. Although other implementations may differ, in the depicted implementation the plurality of openings 634 are substantially randomly distributed across the end 632. Further, although other implementations may differ, the plurality of openings 634 of the depicted implementation comprises a plurality of substantially cylindrical openings. Although in other implementations the openings may have different shapes and sizes, the plurality of openings 634 of the depicted implementation have substantially the same size and shape.

In the depicted implementation, the opposite end 636 of the outer housing 612 includes one or more end apertures 618 (see FIG. 13B) configured to allow aerosolized vapor (herein alternatively referred to as a "vapor" or "aerosol") to pass therethrough. The end apertures 618 of the depicted implementation are in the form of a pair of elongate slots; however, in other implementations the end apertures may have any form that permits passage of the aerosol therethrough. As such, it will be appreciated that the end apertures 618 can comprise fewer or additional apertures and/or alternative shapes and sizes of apertures than those illustrated.

In the depicted implementation, the substrate portion 610 comprises a substrate material 616 having a single segment, although in other implementations the substrate portion may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 616 of the depicted implementation).

Ignition of the heat source 609 of the depicted implementation results in aerosolization of the aerosol precursor composition associated with the substrate material 616. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 616 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 616 may comprise a centrally defined longitudinally extending axis between the opposed first and second ends, and a cross-section of the substrate material 616 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements.

In the depicted implementation, a barrier 628 exists between the second end of the heat source 609 and the first end of the substrate material 616. In particular, in the depicted implementation the barrier 628 separates the heat source 609 from the substrate material 616. In the depicted implementation, the barrier 628 comprises the same material as the outer housing 612; however, in other implementations the barrier may comprise a different material than the outer housing. For example, in some implementations the barrier may comprise a different metal material, a ceramic material, a plastic material, and/or any combination thereof. For example, in some implementations the barrier may be constructed of a metal material (such as, for example, stainless steel, aluminum, brass, copper, silver, gold, and bronze), or a graphite material, or a ceramic material, or a plastic material, or any combinations thereof. In other implementations, the barrier may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the barrier may comprise a glass material comprises one or more layers. In some implementations, in addition or alternatively, a heat transfer component may exist between the heat source and the substrate material. Examples of heat transfer components are described in U.S. patent application Ser. No. 15/923,735, filed on Mar. 16, 2018, and titled Smoking Article with Heat Transfer Component, which is incorporated herein by reference in its entirety.

In various implementations, the barrier may be substantially porous or substantially non-porous. In other implementations, the barrier may include one or more substantially porous portions and one or more substantially non-porous portions. In the depicted implementation, the barrier 628 comprises a substantially solid, non-porous barrier wall. In such a manner, during a draw air enters the substrate material 616 through the plurality of openings 630. FIG. 15A illustrates a perspective view of a removable cartridge, according to another example implementation of the present disclosure, and FIG. 15B illustrates a reverse perspective view of the removable cartridge of FIG. 15A. In particular, FIGS. 15A and 15B illustrate perspective views of a removable cartridge 702. In the depicted implementation, the removable cartridge 702 generally includes a heat portion 708 comprising a heat source (not shown), a substrate portion 710 comprising a substrate material 716 (see FIG. 16), and an outer housing 712 (shown as transparent for illustration purposes) configured to circumscribe at least a portion of the heat source and substrate material 716.

It should be noted that although in the depicted implementation the cartridge 702 has a substantially cylindrical overall shape, in various other implementations, the cartridge 702 or any of its subcomponents, may have other shapes. For example, in some implementations the cartridge (and/or any of its subcomponents) may have a substantially rectangular shape, such as a substantially rectangular cuboid shape. In other implementations, the cartridge 702 (and/or any of their subcomponents) may have other shapes.

In various implementations, the heat source may be configured to generate heat upon ignition thereof. In the depicted implementation, the heat source comprises a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, and n-butane. Combinations of heat sources are also possible.

As noted above, the heat source of the depicted implementation has a substantially cylindrical shape. In some implementations, the heat source may include a plurality of peripheral grooves defined therethrough. In some implementations, the grooves may extend longitudinally from a first end of the heat source to an opposing second end, although in other implementations the grooves need not extend the full length of the heat source. In some implementations, the grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source may have a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 16 illustrates a longitudinal cross-section view of the cartridge 702 of FIGS. 15A and 15B. As shown in the figure, the substrate portion 710 of the depicted implementation has opposed first and second ends. Although dimensions of the various components of the cartridge 702 may vary due to the needs of a particular application, in the depicted implementation the cartridge 702 may have an overall length in an inclusive range of approximately 10 mm to approximately 50 mm and a diameter in an inclusive range of approximately 2 mm to approximately 20 mm. In addition, in the depicted implementation the housing 712 may have a thickness in the inclusive range of approximately 0.05 mm to 0.5 mm. Furthermore, in the depicted implementation the substrate material 716 may have a length in the inclusive range of approximately 5 mm to 50 mm and a diameter slightly less than that of the overall cartridge in order to accommodate the thickness of the housing 712, such as, for example, a diameter in an inclusive range of approximately 2.9 mm to approximately 9.9 mm.

In the depicted implementation, the substrate portion 710 comprises a substrate material 716 having a single segment, although in other implementations the substrate portion 210 may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 716 of the depicted implementation).

Ignition of the heat source of the depicted implementation results in aerosolization of the aerosol precursor composition associated with the substrate material 716. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 716 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 716 may comprise a centrally defined longitudinally extending axis between the opposed first and second ends, and a cross-section of the substrate material 716 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material 716 may comprise an asymmetric cross-section about the axis. In various implementations, each end of the substrate material may be in axial alignment with adjacent elements.

In the depicted implementation, a first barrier 728 exists between the second end of the heat source and the first end of the substrate material 716. In particular, in the depicted implementation the barrier 728 separates the heat source from the substrate material 716. In the depicted implementation, the first barrier 728 comprises the same material as the outer housing 712; however, in other implementations the first barrier may comprise a different material than the outer housing. For example, in some implementations the first barrier may comprise a different metal material, a ceramic material, a plastic material, and/or any combination thereof. For example, in some implementations the first barrier may be constructed of a metal material (such as, for example, stainless steel, aluminum, brass, copper, silver, gold, and bronze), or a graphite material, or a ceramic material, or a plastic material, or any combinations thereof. In other implementations, the first barrier may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the first barrier may comprise a glass material comprises one or more layers. In some implementations, in addition or alternatively, a heat transfer component may exist between the heat source and the substrate material. Examples of heat transfer components are described in U.S. patent application Ser. No. 15/923,735, filed on Mar. 16, 2018, and titled Smoking Article with Heat Transfer Component, which is incorporated herein by reference in its entirety.

In various implementations, the first barrier 728 may be substantially porous or substantially non-porous. In other implementations, the first barrier may include one or more substantially porous portions and one or more substantially non-porous portions. In the depicted implementation, the first barrier 728 comprises a porous barrier wall that includes a pair of apertures 740, which in the depicted implementation, comprise a pair of elongate slots; however, in other implementations the apertures of the first barrier may have any shape.

In the depicted implementation, a second barrier 738 exists proximate a downstream end of the substrate material 716. In particular, in the depicted implementation the second barrier 738 separates the substrate material 716 from the distal end of the cartridge 702. As such, a cooling chamber 742 is created between the second barrier 738 and the distal end of the cartridge 702. In some implementations, the cooling chamber need not include any materials therein and thus may be available to collect aerosol. In other implementations, the cooling chamber may include one or components therein. For example, in some implementations the cooling chamber 742 may include one or more filters therein.

In the depicted implementation, the second barrier 738 comprises the same material as the outer housing 712; however, in other implementations the second barrier may comprise a different material than the outer housing. For example, in some implementations the second barrier may comprise a different metal material, a ceramic material, a plastic material, and/or any combination thereof. For example, in some implementations the second barrier may be constructed of a metal material (such as, for example, stainless steel, aluminum, brass, copper, silver, gold, and bronze), or a graphite material, or a ceramic material, or a plastic material, or any combinations thereof. In other implementations, the second barrier may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the second barrier may comprise a glass material comprises one or more layers. In some implementations, in addition or alternatively, a heat transfer component may exist between the substrate material and the cooling chamber. Examples of heat transfer components are described in U.S. patent application Ser. No. 15/923,735, filed on Mar. 16, 2018, and titled Smoking Article with Heat Transfer Component, which is incorporated herein by reference in its entirety.

In the depicted implementation, the second barrier 738 comprises a porous barrier wall that includes a pair of apertures 744, which in the depicted implementation, comprise a pair of elongate slots; however, in other implementations the apertures 744 of the second barrier 728 may have any shape.

As shown in FIG. 16, the outer housing 712 is configured to circumscribe at least a portion of the substrate portion 710, including the substrate material 716. In the depicted implementation, the outer housing 712 is also configured to circumscribe at least a portion of the heat source. In the depicted implementation, the outer housing comprises a rigid material. For example, the outer housing 712 of the depicted implementation is constructed of an aluminum material; however, in other implementations the outer housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S.patent application Ser. No. 16/174,846, filed on Oct. 30, 2018, and titled Smoking Article Cartridge, which is incorporated herein by reference in its entirety.

In the depicted implementation, the outer housing 712 is constructed as tube structure that substantially encapsulates the substrate material 716; however, as noted above, in other implementations the outer housing 712 may have other shapes. Although the shape of the outer housing may vary, in the depicted implementation the outer housing comprises a tube structure having an open end and a closed end. The depicted implementation of the outer housing 712 also includes one or more end apertures 718 (see FIG. 4B) located on the distal end of the outer housing 712 configured to allow aerosolized vapor (herein alternatively referred to as a "vapor" or "aerosol") to pass therethrough. The end apertures 718 of the depicted implementation are in the form of a pair of elongate slots; however, in other implementations the end apertures may have any form that permits passage of the aerosol therethrough. As such, it will be appreciated that the end apertures 718 can comprise fewer or additional apertures and/or alternative shapes and sizes of apertures than those illustrated.

FIG. 17A illustrates a perspective view of a removable cartridge, according to another example implementation of the present disclosure, and FIG. 17B illustrates a reverse perspective view of the removable cartridge of FIG. 17A. In particular, FIGS. 17A and 17B illustrate perspective views of a removable cartridge 802. In the depicted implementation, the removable cartridge 802 generally includes a heat portion 808 comprising a heat source (not shown), a substrate portion 810 comprising a substrate material 816 (see FIG. 18), and an outer housing 812 (shown as transparent for purposes of illustration) configured to circumscribe at least a portion of the heat source and substrate material 816.

It should be noted that although in the depicted implementation the cartridge 802 has a substantially cylindrical overall shape, in various other implementations, the cartridge or any of its subcomponents, may have other shapes. For example, in some implementations the cartridge 802 (and/or any of its subcomponents) may have a substantially rectangular shape, such as a substantially rectangular cuboid shape. In other implementations, the cartridge 802 (and/or any of their subcomponents) may have other shapes.

In various implementations, the heat source may be configured to generate heat upon ignition thereof. In the depicted implementation, the heat source may comprise a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, and n-butane. Combinations of heat sources are also possible.

In some implementations, the heat source may include a plurality of peripheral grooves defined therethrough. In some implementations, the grooves may extend longitudinally from a first end of the heat source to an opposing second end, although in other implementations the grooves need not extend the full length of the heat source. In some implementations, the grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No.

15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source may have a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source may be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 18 illustrates a longitudinal cross-section view of the cartridge 802 of FIGS. 17A and 17B. As shown in the figure, the substrate material 816 of the depicted implementation has opposed first and second ends. Although dimensions of the various components of the cartridge may vary due to the needs of a particular application, in the depicted implementation the cartridge 802 may have an overall length in an inclusive range of approximately 10 mm to approximately 50 mm and a diameter in an inclusive range of approximately 2 mm to approximately 20 mm. In addition, in the depicted implementation the housing 812 may have a thickness in the inclusive range of approximately 0.05 mm to 0.5 mm. Furthermore, in the depicted implementation the substrate material 816 may have a length in the inclusive range of approximately 5 mm to 50 mm and a diameter slightly less than that of the overall cartridge in order to accommodate the thickness of the housing 812, such as, for example, a diameter in an inclusive range of approximately 2.9 mm to approximately 9.9 mm.

As shown in the figure, the outer housing 812 is configured to circumscribe at least a portion of the substrate portion 810, including the substrate material 816. In the depicted implementation, the outer housing 812 is also configured to circumscribe at least a portion of the heat source. In the depicted implementation, the outer housing comprises a rigid material. For example, the outer housing 812 of the depicted implementation is constructed of an aluminum material; however, in other implementations the outer housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 812 is constructed as tube structure that substantially encapsulates the substrate material 816; however, as noted above, in other implementations the outer housing may have other shapes. Although the shape of the outer housing 812 may vary, in the depicted implementation the outer housing 812 comprises a tube structure having an open end and a closed end. The depicted implementation of the outer housing 812 also includes one or more end apertures 818 (see FIGS. 17A and 17B) located on the closed end of the outer housing 812 configured to allow aerosolized vapor (herein alternatively referred to as a "vapor" or "aerosol") to pass therethrough. The end apertures of the depicted implementation are in the form of a pair of elongate slots; however, in other implementations the end apertures 818 may have any form that permits passage of the aerosol therethrough. As such, it will be appreciated that the end apertures 818 can comprise fewer or additional apertures and/or alternative shapes and sizes of apertures than those illustrated.

In the depicted implementation, the substrate portion 810 comprises a substrate material 816 having a single segment, although in other implementations the substrate portion may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 816 of the depicted implementation).

Ignition of the heat source of the depicted implementation results in aerosolization of the aerosol precursor composition associated with the substrate material 816. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 816 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 816 may comprise a centrally defined longitudinally extending axis between the opposed first and second ends, and a cross-section of the substrate material 816 may be, in some implementations, symmetrical about the axis. For example, in some implementations a cross-section of the substrate material 816 may be substantially circular such that the substrate material 816 defines a substantially cylindrical shape extending between the opposed first and second ends thereof. However, in other implementations, the substrate material 816 may define a substantially non-circular cross-section such that the substrate material 816 may define a substantially non-cylindrical shape between the opposed first and second ends thereof. Otherwise, in other examples, the substrate material 816 may comprise an asymmetric cross-section about the axis. In various implementations, each end of the substrate material 816 may be in axial alignment with adjacent elements.

In the depicted implementation, a barrier 828 exists between the second end of the heat source and the first end of the substrate material 816. In particular, in the depicted implementation the barrier 828 separates the heat source from the substrate material 816. In the depicted implementation, the barrier 828 comprises the same material as the outer housing 812; however, in other implementations the barrier may comprise a different material than the outer housing. For example, in some implementations the barrier may comprise a different metal material, a ceramic material, a plastic material, and/or any combination thereof. For example, in some implementations the barrier may be constructed of a metal material (such as, for example, stainless steel, aluminum, brass, copper, silver, gold, and bronze), or a graphite material, or a ceramic material, or a plastic material, or any combinations thereof. In other implementations, the barrier may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the barrier may comprise a glass material comprises one or more layers. In some implementations, in addition or alternatively, a heat transfer component may exist between the heat source and the substrate material. Examples of heat transfer components are described in U.S. patent application Ser. No. 15/923,735, filed on Mar. 16, 2018, and titled Smoking Article with Heat Transfer Component, which is incorporated herein by reference in its entirety.

In various implementations, the barrier may be substantially porous or substantially non-porous. In other implementations, the barrier may include one or more substantially porous portions and one or more substantially non-porous portions. In the depicted implementation, the barrier 828 comprises a porous wall that includes a central opening 840 and a plurality of peripheral openings 842 disposed around an outer circumference of the barrier 828. In the depicted implementation, the barrier 828 has a curved side and substantially flat side. Although other configurations are possible, in the depicted implementation the curved side of the barrier 828 has a concave shape with respect to the second end of the heat source. In the depicted implementation, the plurality of openings 842 are located on the curved side of the barrier 828, which is configured to be proximate the heat source. The peripheral openings 842 of the barrier 828 of the depicted implementation are substantially evenly spaced and are disposed around the entire circumference of the barrier 828. The outer housing 812 of the depicted implementation also includes a plurality of openings 830 that are defined circumferentially around the outer housing 812 and are configured to align with the plurality of peripheral openings 842 of the barrier 828. Although the openings 830, 842 of the depicted implementation have a substantially cylindrical shape, in other implementations the openings may have any shape. In the depicted implementations, there are approximately fourteen openings; however, in other implementations there may be any number of openings, including as few as one. Although in the depicted implementation the plurality of openings have substantially the same size and shape, in other implementations the openings may have different shapes and/or sizes.

FIG. 19A illustrates a perspective view of a removable cartridge, according to another example implementation of the present disclosure, and FIG. 19B illustrates a reverse perspective view of the removable cartridge of FIG. 19A. In particular, FIGS. 19A and 19B illustrate perspective views of a removable cartridge 902. In the depicted implementation, the removable cartridge 902 generally includes a heat portion 908 comprising a heat source 909 (see FIG. 20), a substrate portion 910 comprising a substrate material 909 (see FIG. 20), and an outer housing 912.

Although other shapes are possible, the outer housing 912 of the depicted implementation has a substantially cylindrical overall shape. In the depicted implementation, the cartridge 902 further comprises an inner housing 930 defined within the outer housing 912. Although other shapes are possible, the inner housing 930 of the depicted implementation also has a substantially cylindrical overall shape that is approximately centrally located within the outer housing 902. For example, the inner housing 930 of the depicted implementation has a smaller outer diameter that the outer diameter of the outer housing 912. In the depicted implementation, the inner housing 930 defines an inner chamber within the inner housing 930, and an outer chamber defined between the outer surface of the inner housing 930 and the inner surface of the outer housing 912. In the depicted implementation, the inner chamber comprises the substrate portion 910 and includes the substrate material 916, and the outer chamber comprises the heat portion 908 and includes the heat source 909 (see FIG. 20).

It should be noted that although in the depicted implementation the cartridge 902 has a substantially cylindrical overall shape, in various other implementations, the cartridge 902 or any of its subcomponents, may have other shapes. For example, in some implementations the cartridge (and/or any of its subcomponents) may have a substantially rectangular shape, such as a substantially rectangular cuboid shape. In other implementations, the cartridge (and/or any of their subcomponents) may have other shapes.

In various implementations, the heat source may be configured to generate heat upon ignition thereof. In the depicted implementation, the heat source may comprise a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, and n-butane. Combinations of heat sources are also possible.

In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source may have a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source may be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 20 illustrates a longitudinal cross-section view of the cartridge 902 of FIGS. 19A and 19B. Although dimensions of the various components of the cartridge 902 may vary due to the needs of a particular application, in the depicted implementation the cartridge 902 may have an overall length in an inclusive range of approximately 10 mm to approximately 50 mm and a diameter in an inclusive range of approximately 2 mm to approximately 20 mm. In addition, in the depicted implementation the outer housing 912 and/or the inner housing 930 may have a thickness in the inclusive range of approximately 0.05 mm to 0.5 mm. Furthermore, in the depicted implementation the substrate material 916 may have a length in the inclusive range of approximately 5 mm to 50 mm and a diameter in an inclusive range of approximately 1 mm to approximately 18 mm. In addition, in the depicted implementation the heat portion 908 may have a length in the inclusive range of approximately 5 mm to 50 mm and a diameter in an inclusive range of approximately 2 mm to approximately 20 mm.

In the depicted implementation, the outer housing 912 and the inner housing 930 comprise a rigid material. For example, the outer housing 912 and inner housings 930 of the depicted implementation are constructed of an aluminum material; however, in other implementations one or both the outer housing 912 and/or inner housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the inner housing 930 of the depicted implementation substantially encapsulates the substrate material 916, and the outer housing 912 (and more particularly, the area between the inner housing 930 and the outer housing 912) substantially encapsulates the heat source 909. The outer housing 912 of the depicted implementation comprises an open end and a closed end. In the depicted implementation, the outer housing 912 also includes one or more end apertures 918 (see FIG. 19B) located on the closed end of the outer housing 912 configured to allow aerosolized vapor (herein alternatively referred to as a "vapor" or "aerosol") to pass therethrough. The end apertures 918 of the depicted implementation are in the form of a pair of elongate slots; however, in other implementations the end apertures may have any form that permits passage of the aerosol therethrough. As such, it will be appreciated that the end apertures 918 can comprise fewer or additional apertures and/or alternative shapes and sizes of apertures than those illustrated.

In the depicted implementation, the substrate portion 910 comprises a substrate material 916 having a single segment, although in other implementations the substrate portion may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 516 of the depicted implementation).

Ignition of the heat source 909 of the depicted implementation results in aerosolization of the aerosol precursor composition associated with the substrate material 916. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 916 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 916 may comprise a centrally defined longitudinally extending axis between opposed first and second ends, and a cross-section of the substrate material 916 may be, in some implementations, symmetrical about the axis. Likewise, in the depicted implementation the heat source 909 may comprise a centrally defined longitudinally extending axis between opposed first and second ends, and a cross-section of the heat source 909 may be, in some implementations, symmetrical about the axis. For example, in the depicted implementation a cross-section of the substrate material 916 may be substantially circular such that the substrate material 916 defines a substantially cylindrical shape extending between the opposed first and second ends thereof. In addition, the cross-section of the heat source 909 of the depicted implementation may be substantially ring-shaped such that the heat source 909 defines a substantially tubular shape extending between the opposed first and second ends thereof. In other implementations, however, the substrate material may define a substantially non-circular cross-section such that the substrate material may define a substantially non-cylindrical shape between the opposed first and second ends thereof, and the heat source may define a substantially non-ring-shape cross-section such that the heat source may define a substantially non-tubular shape between the opposed first and second ends. In still other implementations, one or both the substrate material and/or the heat source may comprise an asymmetric cross-section about the axis.

In the depicted implementation, the inner housing 930 serves as a barrier between the heat source 909 and the substrate material 916. In particular, in the depicted implementation the inner housing 930 separates the heat source 909 from the substrate material 916. As noted above, the inner housing 930 of the depicted implementation comprises the same material as the outer housing 912; however, in other implementations the inner housing may comprise a different material than the outer housing. For example, in some implementations the inner housing may comprise a different metal material, a ceramic material, a plastic material, and/or any combination thereof. In general, for example, in some implementations the inner housing may be constructed of a metal material (such as, for example, stainless steel, aluminum, brass, copper, silver, gold, and bronze), or a graphite material, or a ceramic material, or a plastic material, or any combinations thereof. In other implementations, the inner housing may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the inner housing may comprise a glass material comprises one or more layers. In some implementations, in addition or alternatively, a heat transfer component may exist between the heat source and the substrate material. Examples of heat transfer components are described in U.S. patent application Ser. No. 15/923,735, filed on Mar. 16, 2018, and titled Smoking Article with Heat Transfer Component, which is incorporated herein by reference in its entirety.

In various implementations, the inner housing may be substantially porous or substantially non-porous. In other implementations, the inner housing may include one or more substantially porous portions and one or more substantially non-porous portions. In the depicted implementation, the inner housing 930 comprises a substantially solid, non-porous barrier. FIG. 21A illustrates a perspective view of a removable cartridge, according to another example implementation of the present disclosure, and FIG. 21B illustrates a reverse perspective view of the removable cartridge of FIG. 21A. In particular, FIGS. 21A and 21B illustrate perspective views of a removable cartridge 1002. In the depicted implementation, the removable cartridge 1002 generally includes a heat portion 1008 comprising a heat source 1009 (see FIG. 22), a substrate portion 1010 comprising a substrate material 1016 (see FIG. 22), and an outer housing 1012.

Although other shapes are possible, the outer housing 1012 of the depicted implementation has a substantially cylindrical overall shape. In the depicted implementation, the cartridge 1002 further comprises an inner housing 1030 defined within the outer housing 1012. For example, the inner housing 1030 of the depicted implementation has a smaller outer diameter that the outer diameter of the outer housing 1012. Although other shapes are possible, the inner housing 1030 of the depicted implementation also has a substantially cylindrical overall shape that is approximately centrally located within the outer housing 1002. In the depicted implementation, the inner housing 1030 defines an inner chamber within the inner housing 1030, and an outer chamber defined between the outer surface of the inner housing 1030 and the inner surface of the outer housing 1012. In the depicted implementation, the inner chamber comprises the heat portion 1008 and includes the heat source 1009, and the outer chamber comprises the substrate portion 1010 and includes the substrate material 1016.

It should be noted that although in the depicted implementation the cartridge 1002 has a substantially cylindrical overall shape, in various other implementations, the cartridge or any of its subcomponents, may have other shapes. For example, in some implementations the cartridge (and/or any of its subcomponents) may have a substantially rectangular shape, such as a substantially rectangular cuboid shape. In other implementations, the cartridge (and/or any of their subcomponents) may have other shapes.

In various implementations, the heat source may be configured to generate heat upon ignition thereof. In the depicted implementation, the heat source may comprise a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, and n-butane. Combinations of heat sources are also possible. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source may have a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source may be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 22 illustrates a longitudinal cross-section view of the cartridge 1002 of FIGS. 21A and 21B. Although dimensions of the various components of the cartridge 1002 may vary due to the needs of a particular application, in the depicted implementation the cartridge 1002 may have an overall length in an inclusive range of approximately 10 mm to approximately 50 mm and a diameter in an inclusive range of approximately 2 mm to approximately 20 mm. In addition, in the depicted implementation the outer housing 1012 and/or the inner housing 1030 may have a thickness in the inclusive range of approximately 0.05 mm to 0.5 mm. Furthermore, in the depicted implementation the substrate material 1016 may have a length in the inclusive range of approximately 5 mm to 50 mm and a diameter in an inclusive range of approximately 1 mm to approximately 20 mm. In addition, in the depicted implementation the heat source 909 may have a length in the inclusive range of approximately 5 mm to 50 mm and a diameter in an inclusive range of approximately 1 mm to approximately 18 mm.

In the depicted implementation, the outer housing 1012 and the inner housing 1030 comprise a rigid material. For example, the outer housing 1012 and the inner housings 1030 of the depicted implementation are constructed of an aluminum material; however, in other implementations one or both the outer housing and/or inner housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the inner housing 1030 substantially encapsulates the heat source 1009, and the outer housing 1012 (and more particularly, the area between the inner housing 1030 and the outer housing 1012) substantially encapsulates the substrate material 1016. In the depicted implementation, the outer housing 1012 comprises an open end and a closed end. In the depicted implementation, the outer housing 1012 also includes one or more end apertures 1018 (see FIG. 21B) located on the closed end of the outer housing 1012 that are configured to allow aerosolized vapor (herein alternatively referred to as a "vapor" or "aerosol") to pass therethrough. The end apertures 1018 of the depicted implementation are in the form of a series of radial cylindrical openings that extend through closed end of the outer housing 1012; however, in other implementations the end apertures may have any form that permits passage of the aerosol therethrough. As such, it will be appreciated that the end apertures 1018 can comprise fewer or additional apertures and/or alternative shapes and sizes of apertures than those illustrated.

In the depicted implementation, the substrate portion 1010 comprises a substrate material 1016 having a single segment, although in other implementations the substrate portion may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 1016 of the depicted implementation).

Ignition of the heat source 1009 of the depicted implementation results in aerosolization of the aerosol precursor composition associated with the substrate material 1016. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 916 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 1016 may comprise a centrally defined longitudinally extending axis between opposed first and second ends, and a cross-section of the substrate material 1016 may be, in some implementations, symmetrical about the axis. Likewise, in the depicted implementation the heat source 1009 may comprise a centrally defined longitudinally extending axis between opposed first and second ends, and a cross-section of the heat source 1009 may be, in some implementations, symmetrical about the axis. For example, in the depicted implementation a cross-section of the heat source 1009 may be substantially circular such that the heat source 1009 defines a substantially cylindrical shape extending between the opposed first and second ends thereof. In addition, the cross-section of the substrate material 1016 of the depicted implementation may be substantially ring-shaped such that the substrate material 1016 defines a substantially tubular shape extending between the opposed first and second ends thereof. In other implementations, however, the heat source may define a substantially non-circular cross-section such that the heat source may define a substantially non-cylindrical shape between the opposed first and second ends thereof, and the substrate material may define a substantially non-ring-shape cross-section such that the substrate material may define a substantially non-tubular shape between the opposed first and second ends. In still other implementations, one or both the substrate material and/or the heat source may comprise an asymmetric cross-section about the axis.

In the depicted implementation, the inner housing 1030 serves as a barrier between the heat source 1009 and the substrate material 1016. In particular, in the depicted implementation the inner housing 1030 separates the heat source 1009 from the substrate material 1016. As noted above, the inner housing 1030 of the depicted implementation comprises the same material as the outer housing 1012; however, in other implementations the inner housing may comprise a different material than the outer housing. For example, in some implementations the inner housing may comprise a different metal material, a ceramic material, a plastic material, and/or any combination thereof. In general, for example, in some implementations the inner housing may be constructed of a metal material (such as, for example, stainless steel, aluminum, brass, copper, silver, gold, and bronze), or a graphite material, or a ceramic material, or a plastic material, or any combinations thereof. In other implementations, the inner housing may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the inner housing may comprise a glass material comprises one or more layers. In some implementations, in addition or alternatively, a heat transfer component may exist between the heat source and the substrate material. Examples of heat transfer components are described in U.S.

patent application Ser. No. 15/923,735, filed on Mar. 16, 2018, and titled Smoking Article with Heat Transfer Component, which is incorporated herein by reference in its entirety.

In various implementations, the inner housing may be substantially porous or substantially non-porous. In other implementations, the inner housing may include one or more substantially porous portions and one or more substantially non-porous portions. In the depicted implementation, the inner housing 930 comprises a substantially solid, non-porous barrier.

FIG. 23A illustrates a perspective view of a removable cartridge, according to another example implementation of the present disclosure, and FIG. 23B illustrates a reverse perspective view of the removable cartridge of FIG. 23A. In particular, FIGS. 23A and 23B illustrate perspective views of a removable cartridge 1102. In the depicted implementation, the removable cartridge 1102 generally includes a heat portion 1108 comprising a heat source 1109 (see FIG. 24), a substrate portion 1110 comprising a substrate material 1116 (see FIG. 24), and an outer housing 1112.

Although other shapes are possible, the outer housing 1112 of the depicted implementation has a substantially cylindrical overall shape. In the depicted implementation, the cartridge 1102 further comprises an inner housing 1130 defined within the outer housing 1112. For example, the inner housing 1130 of the depicted implementation has a smaller outer diameter that the outer diameter of the outer housing 1112. Although other shapes are possible, the inner housing 1130 of the depicted implementation also has a substantially cylindrical overall shape that is approximately centrally located within the outer housing 1102. In the depicted implementation, the inner housing 1130 defines an inner chamber within the inner housing 1130, and an outer chamber defined between the outer surface of the inner housing 1130 and the inner surface of the outer housing 1112. In the depicted implementation, the inner chamber comprises the heat portion 1108 and includes the heat source 1109, and the outer chamber comprises the substrate portion 1110 and includes the substrate material 1116.

It should be noted that although in the depicted implementation the cartridge 1102 has a substantially cylindrical overall shape, in various other implementations, the cartridge or any of its subcomponents, such as, for example, the heat source, the outer housing, and/or the substrate material of the cartridge) may have different shapes. For example, in some implementations the cartridge (and/or any of its subcomponents) may have a substantially rectangular shape, such as a substantially rectangular cuboid shape. In other implementations, the cartridge (and/or any of their subcomponents) may have other shapes.

In various implementations, the heat source may be configured to generate heat upon ignition thereof. In the depicted implementation, the heat source may comprise a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, and n-butane. Combinations of heat sources are also possible.

In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Although specific dimensions of an applicable heat source may vary, in the depicted implementation, the heat source may have a length in an inclusive range of approximately 5 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source may be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No.

7,836,897 to Borschke et al., which are incorporated herein by reference in their entireties.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 24 illustrates a longitudinal cross-section view of the cartridge 1102 of FIGS. 23A and 23B. Although dimensions of the various components of the cartridge 1102 may vary due to the needs of a particular application, in the depicted implementation the cartridge 1102 may have an overall length in an inclusive range of approximately 10 mm to approximately 50 mm and a diameter in an inclusive range of approximately 2 mm to approximately 20 mm. In addition, in the depicted implementation the outer housing 1012 and/or the inner housing 1030 may have a thickness in the inclusive range of approximately 0.05 mm to 0.5 mm. Furthermore, in the depicted implementation the substrate material 1116 may have a length in the inclusive range of approximately 5 mm to 50 mm and a diameter in an inclusive range of approximately 1 mm to approximately 20 mm. In addition, in the depicted implementation the heat source 909 may have a length in the inclusive range of approximately 5 mm to 50 mm and a diameter in an inclusive range of approximately 1 mm to approximately 18 mm.

In the depicted implementation, the outer housing 1112 and the inner housing 1130 comprise a rigid material. For example, the outer housing 1112 and the inner housings 1130 of the depicted implementation are constructed of an aluminum material; however, in other implementations one or both the outer housing and/or inner housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the inner housing 1130 substantially encapsulates the heat source 1109, and the outer housing 1112 (and more particularly, the area between the inner housing 1130 and the outer housing 1112) substantially encapsulates the substrate material 1116. In the depicted implementation, the outer housing 1112 comprises a pair of closed ends, both of which are substantially porous. In particular, one end of the outer housing 1112 of the depicted implementation includes a plurality of radial openings 1134, as well as a pair of elongate slots 1135, and the opposite end includes a plurality of radial openings. In the depicted implementation, the radial openings 1134 are configured to allow for airflow into the substrate material 1116 and aerosolized vapor (herein alternatively referred to as a "vapor" or "aerosol") to pass therethrough to openings 1118, such as during a draw. The elongate slots 1135 are configured to allow for lighting of the heat source 1109 and to provide sufficient access to air to maintain combustion. It should be noted that in other implementations, any of the openings 1134, 1135, and/or 1118 may have different configurations than those shown, including more or less openings and/or openings having different sizes and shapes. As such, it will be appreciated that the end apertures 1118 can comprise fewer or additional apertures and/or alternative shapes and sizes of apertures than those illustrated.

In the depicted implementation, the substrate portion 1110 comprises a substrate material 1116 having a single segment, although in other implementations the substrate portion may include one or more additional substrate material segments. For example in some implementations, the smoking article may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material 1116 of the depicted implementation).

Ignition of the heat source 1109 of the depicted implementation results in aerosolization of the aerosol precursor composition associated with the substrate material 1116. In various implementations, a mouthpiece portion or a holder may be configured to receive the generated aerosol therethrough in response to a draw applied to the mouthpiece portion by a user. In some implementations the mouthpiece portion may comprise a filter configured to receive the aerosol therethrough in response to the draw applied to the mouthpiece portion. In various implementations, the filter may be provided, in some aspects, as a circular disc radially and/or longitudinally disposed proximate the end of the holder opposite the receiving end. In this manner, upon a draw on the mouthpiece portion, the filter may receive the aerosol flowing through holder of the smoking article. In some implementations, the filter may comprise discrete segments. For example, some implementations may include a segment providing filtering, a segment providing draw resistance, a hollow segment providing a space for the aerosol to cool, other filter segments, and any one or any combination of the above. In some implementations, the filter may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In the depicted implementation, the substrate material 916 comprises a plurality of tobacco beads together formed into a substantially cylindrical portion. In various implementations, however, the substrate material may comprise a variety of different compositions and combinations thereof, as explained in more detail below.

The substrate material of the depicted implementation may have many similar characteristics as that of the substrate material described above. As such, reference is made to the pertinent discussions of these characteristics (and variations thereof), which will not be repeated here.

In the depicted implementation, the substrate material 1116 may comprise a centrally defined longitudinally extending axis between opposed first and second ends, and a cross-section of the substrate material 1116 may be, in some implementations, symmetrical about the axis. Likewise, in the depicted implementation the heat source 1109 may comprise a centrally defined longitudinally extending axis between opposed first and second ends, and a cross-section of the heat source 1109 may be, in some implementations, symmetrical about the axis. For example, in the depicted implementation a cross-section of the heat source 1109 may be substantially circular such that the heat source 1109 defines a substantially cylindrical shape extending between the opposed first and second ends thereof. In the depicted implementation, the cross-section of the substrate material 1116 may be substantially ring-shaped such that the substrate material 1116 defines a substantially tubular shape extending between the opposed first and second ends thereof. In other implementations, however, the heat source may define a substantially non-circular cross-section such that the heat source may define a substantially non-cylindrical shape between the opposed first and second ends thereof, and the substrate material may define a substantially non-ring-shape cross-section such that the substrate material may define a substantially non-tubular shape between the opposed first and second ends. In still other implementations, one or both the substrate material and/or the heat source may comprise an asymmetric cross-section about the axis.

In the depicted implementation, the inner housing 1130 serves as a barrier between the heat source 1109 and the substrate material 1116. In particular, in the depicted implementation the inner housing 1130 separates the heat source 1109 of the heat portion 1108 from the substrate material 1116 of the substrate portion 1110. As noted above, the inner housing 1130 of the depicted implementation comprises the same material as the outer housing 1112; however, in other implementations the inner housing may comprise a different material than the outer housing. For example, in some implementations the inner housing may comprise a different metal material, a ceramic material, a plastic material, and/or any combination thereof. In general, for example, in some implementations the inner housing may be constructed of a metal material (such as, for example, stainless steel, aluminum, brass, copper, silver, gold, and bronze), or a graphite material, or a ceramic material, or a plastic material, or any combinations thereof. In other implementations, the inner housing may comprise a plurality of beaded aluminum pieces (such as, for example, aluminum spheres), glass gems (such as, for example, glass spheres), ceramic pieces (such as, for example ceramic spheres), and/or any combination thereof. In still other implementations, the inner housing may comprise a glass material comprises one or more layers. In some implementations, in addition or alternatively, a heat transfer component may exist between the heat source and the substrate material. Examples of heat transfer components are described in U.S. patent application Ser. No. 15/923,735, filed on Mar. 16, 2018, and titled Smoking Article with Heat Transfer Component, which is incorporated herein by reference in its entirety.

In various implementations, the inner housing may be substantially porous or substantially non-porous. In other implementations, the inner housing may include one or more substantially porous portions and one or more substantially non-porous portions. In the depicted implementation, the inner housing 1130 comprises a substantially solid, non-porous barrier.

Although a smoking article according to the disclosure may take on a variety of implementations, as discussed in detail herein, the use of the smoking article by a consumer will be similar in scope. The foregoing description of use of the smoking article is applicable to the various implementations described through minor modifications, which are apparent to the person of skill in the art in light of the further disclosure provided herein. The description of use, however, is not intended to limit the use of the inventive article but is provided to comply with all necessary requirements of disclosure herein.

Although in some implementations of the present disclosure a cartridge and a holder may be provided together as a complete aerosol delivery device generally, these components may be provided separately. For example, the present disclosure also encompasses a disposable unit for use with a reusable unit. In specific implementations, such a disposable unit (which may be a cartridge as illustrated in the appended figures) can be configured to engage a reusable unit (which may be a holder as illustrated in the appended figures). In still other configurations, a cartridge may comprise a reusable unit and a holder may comprise a disposable unit.

Although some figures described herein illustrate a cartridge and a holder in a working relationship, it is understood that the cartridge and the holder may exist as individual components. Accordingly, any discussion otherwise provided herein in relation to the components in combination also should be understood as applying to the holder and the cartridge as individual and separate components.

In another aspect, the present disclosure may be directed to kits that provide a variety of components as described herein. For example, a kit may comprise a holder with one or more cartridges. In further implementations, a kit may comprise a plurality of cartridges. The inventive kits may further include a case (or other packaging, carrying, or storage component) that accommodates one or more of the further kit components. The case could be a reusable hard or soft container. Further, the case could be simply a box or other packaging structure.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a holder; and a cartridge comprising:

a rigid outer housing;

a heat portion comprising a heat source configured to generate heat; and a substrate portion comprising a substrate material including an aerosol precursor composition, wherein the outer housing comprises a heat end and a substrate end, wherein at least one of the ends of the outer housing includes at least one opening, and wherein the cartridge is configured to be removable and replaceable within the holder, wherein the heat portion and the substrate portion are contained within the outer housing of the cartridge, wherein the cartridge further comprises a barrier disposed between the heat portion and the substrate portion, and wherein the barrier comprises a substantially non-porous barrier wall, wherein the at least one opening of the outer housing of the cartridge comprises a pair of elongate slots, and wherein the elongate slots are located on the substrate end of the outer housing.

2. The aerosol delivery device of claim 1, wherein the outer housing of the cartridge has a substantially cylindrical shape.

3. The aerosol delivery device of claim 1, wherein the heat source comprises a carbon-based heat source.

4. The aerosol delivery device of claim 1, wherein the substrate material comprises one or more of tobacco-containing beads, tobacco shreds, tobacco strips, pieces of a reconstituted tobacco material, tobacco rods, or non-tobacco materials.

5. The aerosol delivery device of claim 1 further comprising at least one opening defined circumferentially around at least a portion of the outer housing proximate the barrier and the substrate portion, wherein the at least one opening is configured to receive air flow in response to a draw by a user.

* * * * *